US009303477B2

(12) United States Patent
Harris et al.

(10) Patent No.: US 9,303,477 B2
(45) Date of Patent: Apr. 5, 2016

(54) METHODS AND APPARATUS FOR CEMENTING WELLS

(76) Inventors: Michael J. Harris, Houston, TX (US); Martin Alfred Stulberg, Angleton, TX (US)

( * ) Notice: Subject to any disclaimer, the term of this patent is extended or adjusted under 35 U.S.C. 154(b) by 902 days.

(21) Appl. No.: 13/506,227

(22) Filed: Apr. 5, 2012

(65) Prior Publication Data

US 2013/0180715 A1 Jul. 18, 2013

(51) Int. Cl.

| | |
|---|---|
| ***E21B 33/13*** | (2006.01) |
| ***E21B 23/08*** | (2006.01) |
| ***E21B 23/01*** | (2006.01) |
| ***E21B 23/04*** | (2006.01) |
| ***E21B 23/06*** | (2006.01) |
| ***E21B 33/04*** | (2006.01) |
| ***E21B 33/14*** | (2006.01) |
| ***E21B 43/10*** | (2006.01) |

(52) U.S. Cl.

CPC ..... *E21B 23/01* (2013.01); *E21B 23/04* (2013.01); *E21B 23/06* (2013.01); *E21B 33/04* (2013.01); *E21B 33/14* (2013.01); *E21B 43/103* (2013.01); *E21B 43/105* (2013.01)

(58) Field of Classification Search

CPC ..... E21B 33/13; E21B 33/14; E21B 33/146; E21B 23/00; E21B 23/01; E21B 23/03; E21B 23/08

USPC ..... 166/208

See application file for complete search history.

(56) References Cited

U.S. PATENT DOCUMENTS

| | | | | |
|---|---|---|---|---|
| 2,263,758 | A | 11/1941 | Brown | |
| 2,804,927 | A | 9/1957 | Hall | |
| 3,223,159 | A * | 12/1965 | Brown | 166/290 |
| 3,393,002 | A | 7/1968 | Woolley | |
| 3,460,617 | A | 8/1969 | Brown et al. | |
| 3,712,376 | A | 1/1973 | Owen et al. | |
| 3,776,307 | A | 12/1973 | Young | |
| 3,821,962 | A | 7/1974 | Matt | |
| 3,948,321 | A | 4/1976 | Owen et al. | |

(Continued)

FOREIGN PATENT DOCUMENTS

| | | |
|---|---|---|
| EP | 0454466 A2 | 10/1991 |
| EP | 0539020 B1 | 4/1993 |

(Continued)

OTHER PUBLICATIONS

*Brown Oil Tools—Production Equipment Catalog*, pp. 812-814.

(Continued)

*Primary Examiner* — Cathleen Hutchins
*Assistant Examiner* — Ronald Runyan
(74) *Attorney, Agent, or Firm* — Keith B. Willhelm

(57) ABSTRACT

Return flow diverters are provided for which are adapted to allow return flow during cementing of a liner for a well. The return flow diverter comprises a cylindrical body adapted for installation in a well as part of the liner. The cylindrical body has a fluid port therein adapted to allow fluids displaced by a cementing operation to flow from an annulus between the liner and the well into the cylindrical body. The return flow diverter also comprises a cover supported on the cylindrical body for movement from an open position, in which the port is open, to a closed position, in which the port is closed by the cover, a transmission disposed within the cylindrical body and defining a cylindrical passageway adapted to accommodate a tubular conduit.

34 Claims, 16 Drawing Sheets

(56) References Cited

U.S. PATENT DOCUMENTS 3,949,150 A 4/1976 Mason et al.
4,151,875 A 5/1979 Sullaway
4,256,179 A 3/1981 Shillander
4,320,800 A 3/1982 Upchurch
4,424,860 A 1/1984 McGill
4,460,040 A 7/1984 Bowyer
4,595,060 A 6/1986 Beck
4,603,743 A 8/1986 Lindsey, Jr.
4,681,159 A 7/1987 Allwin et al.
4,926,938 A 5/1990 Lindsey, Jr.
4,950,844 A 8/1990 Hallmark
4,969,517 A * 11/1990 Valka et al. ..... 166/208
5,009,002 A 4/1991 Kelly
5,038,860 A 8/1991 Baugh et al.
5,062,199 A 11/1991 Kelly
5,086,843 A 2/1992 Mims et al.
5,131,468 A 7/1992 Lane et al.
5,156,210 A 10/1992 Roth
5,180,015 A 1/1993 Ringgenberg et al.
5,181,570 A 1/1993 Allwin et al.
5,333,692 A 8/1994 Baugh et al.
5,396,953 A * 3/1995 Holder et al. ..... 166/129
5,413,173 A 5/1995 Mills et al.
5,467,819 A 11/1995 Braddick
5,511,620 A 4/1996 Baugh et al.
5,544,712 A 8/1996 McEwen et al.
5,553,672 A 9/1996 Smith, Jr. et al.
5,564,501 A 10/1996 Strattan et al.
5,686,369 A 11/1997 Chen et al.
5,787,981 A 8/1998 Taylor
5,832,996 A 11/1998 Carmody et al.
6,102,117 A 8/2000 Swor et al.
6,112,811 A 9/2000 Kilgore et al.
6,145,595 A 11/2000 Burris, II
6,151,810 A 11/2000 Mukai
6,269,874 B1 8/2001 Rawson et al.
6,321,847 B1 11/2001 Brown
6,354,372 B1 3/2002 Carisella et al.
6,446,724 B2 9/2002 Baugh et al.
6,513,600 B2 2/2003 Ross
6,536,532 B2 3/2003 Doane
6,561,271 B2 5/2003 Baugh et al.
6,568,471 B1 5/2003 Cook et al.
6,598,677 B1 7/2003 Baugh et al.
6,619,391 B2 9/2003 Weinig et al.
6,622,789 B1 9/2003 Braddock
6,631,765 B2 10/2003 Baugh et al.
6,634,424 B2 10/2003 Knowles
6,648,075 B2 11/2003 Badrak et al.
6,666,276 B1 12/2003 Yokley et al.
6,688,399 B2 2/2004 Maguire et al.
6,691,788 B1 2/2004 Dearing
6,691,789 B2 2/2004 Jackson et al.
6,705,615 B2 3/2004 Milberger et al.
6,732,806 B2 5/2004 Mauldin et al.
6,739,398 B1 * 5/2004 Yokley et al. ..... 166/382
6,752,216 B2 6/2004 Coon
6,761,221 B1 7/2004 Yokley et al.
6,763,893 B2 7/2004 Braddick
6,772,836 B2 8/2004 Schetky et al.
6,782,953 B2 8/2004 Maguire et al.
6,799,637 B2 10/2004 Schetky et al.
6,808,024 B2 10/2004 Schwendemann et al.
6,814,143 B2 11/2004 Braddick
6,817,409 B2 11/2004 Howard
6,857,473 B2 2/2005 Cook et al.
6,880,632 B2 4/2005 Tom et al.
6,899,181 B2 5/2005 Simpson et al.
6,899,183 B2 5/2005 Dewey et al.
6,915,852 B2 7/2005 Baugh et al.
6,920,934 B2 7/2005 Badrak et al.
6,920,935 B2 7/2005 Metcalfe
6,923,261 B2 8/2005 Metcalfe et al.
6,962,206 B2 11/2005 Herth et al.
6,968,618 B2 11/2005 Cook et al.
6,976,541 B2 12/2005 Brisco et al.
6,997,252 B2 2/2006 Porter et al.
6,997,266 B2 2/2006 Jackson et al.
7,021,390 B2 4/2006 Cook et al.
7,028,780 B2 4/2006 Maguire
7,032,679 B2 4/2006 Maguire et al.
7,036,581 B2 5/2006 Trahan
7,036,582 B2 5/2006 Cook et al.
7,044,218 B2 5/2006 Cook et al.
7,048,065 B2 5/2006 Badrak et al.
7,077,213 B2 7/2006 Cook et al.
7,093,656 B2 8/2006 Maguire
7,114,573 B2 10/2006 Hirth et al.
7,117,941 B1 10/2006 Gano et al.
7,117,949 B2 10/2006 Doane et al.
7,117,957 B2 10/2006 Metcalf et al.
7,121,337 B2 10/2006 Cook et al.
7,124,821 B2 10/2006 Metcalf et al.
7,124,827 B2 10/2006 Braddick
7,124,829 B2 10/2006 Braddick
7,128,146 B2 10/2006 Baugh et al.
7,156,182 B2 1/2007 Lynde et al.
7,165,622 B2 1/2007 Herth et al.
7,168,496 B2 1/2007 Cook et al.
7,172,021 B2 2/2007 Brisco et al.
7,172,027 B2 2/2007 Simpson et al.
7,222,669 B2 5/2007 Sonnier et al.
7,225,880 B2 6/2007 Braddick
7,231,985 B2 6/2007 Cook et al.
7,240,728 B2 7/2007 Cook et al.
7,240,729 B2 7/2007 Cook et al.
7,246,667 B2 7/2007 Cook et al.
7,258,168 B2 8/2007 Cook et al.
7,278,492 B2 10/2007 Braddick
7,303,020 B2 12/2007 Bishop et al.
7,341,110 B2 3/2008 Doane et al.
7,341,111 B2 3/2008 Van et al.
7,350,588 B2 4/2008 Abercrombie Simpson et al.
7,367,390 B2 5/2008 Carmody et al.
7,367,404 B2 5/2008 Simpson et al.
7,377,322 B2 5/2008 Hofman
7,387,169 B2 6/2008 Harrell et al.
7,392,849 B2 7/2008 Lauderdale et al.
7,424,910 B2 9/2008 Xu et al.
7,431,096 B2 10/2008 Fay
7,441,606 B2 10/2008 Maguire
7,469,750 B2 12/2008 Carr
7,481,461 B2 1/2009 McGarian et al.
7,493,945 B2 2/2009 Doane et al.
7,493,946 B2 2/2009 Filippov et al.
7,497,255 B2 3/2009 Filippov et al.
7,516,791 B2 4/2009 Bryant et al.
7,543,639 B2 6/2009 Emerson
7,546,881 B2 6/2009 Lloyd et al.
7,552,766 B2 6/2009 Gazewood
7,562,714 B2 7/2009 Lynde
7,607,476 B2 10/2009 Tom et al.
7,617,868 B2 11/2009 Stuart et al.
7,640,976 B2 1/2010 Filippov
7,730,941 B2 6/2010 Abarca et al.
7,779,910 B2 8/2010 Watson
7,784,797 B2 8/2010 Baugh et al.
7,895,726 B2 3/2011 Maguire
8,006,770 B2 8/2011 Watson
2002/0014339 A1 2/2002 Ross
2002/0070032 A1 6/2002 Maguire et al.
2002/0079103 A1 6/2002 Knowles
2002/0174985 A1 * 11/2002 Vincent et al. ..... 166/285
2003/0024708 A1 2/2003 Ring et al.
2003/0075339 A1 4/2003 Gano et al.
2003/0098164 A1 5/2003 Hirth
2003/0188868 A1 10/2003 Simpson et al.
2003/0209352 A1 11/2003 Davis et al.
2004/0016545 A1 1/2004 Baugh et al.
2004/0020660 A1 2/2004 Johnson et al.
2004/0055754 A1 3/2004 MacKay et al.
2004/0089454 A1 5/2004 Hackworth et al.
2004/0144538 A1 7/2004 Richard et al.
2004/0168796 A1 9/2004 Baugh et al.

(56) References Cited

U.S. PATENT DOCUMENTS

| | | | | |
|---|---|---|---|---|
| 2004/0173360 | A1 | 9/2004 | Harrall et al. | |
| 2004/0219831 | A1 | 11/2004 | Hall et al. | |
| 2004/0228679 | A1 | 11/2004 | Reavis et al. | |
| 2004/0231838 | A1 | 11/2004 | Carmody et al. | |
| 2006/0032628 | A1 | 2/2006 | McGarian et al. | |
| 2006/0076147 | A1 | 4/2006 | Ring | |
| 2006/0124295 | A1 | 6/2006 | Maguire | |
| 2006/0162921 | A1 | 7/2006 | Carmody et al. | |
| 2006/0175404 | A1 | 8/2006 | Zierolf | |
| 2007/0095532 | A1 | 5/2007 | Head et al. | |
| 2007/0131416 | A1 | 6/2007 | Odell et al. | |
| 2007/0221374 | A1 | 9/2007 | Filippov et al. | |
| 2007/0272405 | A1 | 11/2007 | Gazewood | |
| 2008/0110643 | A1 | 5/2008 | Richard et al. | |
| 2008/0199642 | A1 | 8/2008 | Barlow | |
| 2008/0236844 | A1 | 10/2008 | Gaudette et al. | |
| 2008/0257560 | A1 | 10/2008 | Brisco et al. | |
| 2009/0032266 | A1 | 2/2009 | Farquhar et al. | |
| 2009/0107686 | A1 | 4/2009 | Watson | |
| 2009/0133930 | A1 | 5/2009 | Thorp et al. | |
| 2009/0211748 | A1* | 8/2009 | Revheim | 166/66.5 |
| 2009/0223717 | A1 | 9/2009 | Eppink | |
| 2009/0229832 | A1 | 9/2009 | King | |
| 2009/0229835 | A1 | 9/2009 | Filippov | |
| 2009/0242213 | A1 | 10/2009 | Braddick | |
| 2010/0089592 | A1 | 4/2010 | Ring et al. | |
| 2010/0155082 | A1 | 6/2010 | Braddick | |
| 2010/0155084 | A1 | 6/2010 | Watson et al. | |
| 2010/0252252 | A1 | 10/2010 | Harris et al. | |
| 2010/0252278 | A1* | 10/2010 | Harris et al. | 166/382 |

FOREIGN PATENT DOCUMENTS

| | | | |
|---|---|---|---|
| EP | 0928879 | B1 | 7/1999 |
| EP | 1030031 | B1 | 8/2000 |
| EP | 1052369 | A2 | 11/2002 |
| EP | 1600600 | A2 | 11/2005 |
| EP | 1717411 | A1 | 2/2006 |
| EP | 2072750 | A2 | 6/2009 |
| EP | 2103774 | A1 | 9/2009 |
| EP | 2119867 | A2 | 11/2009 |
| EP | 2175101 | A2 | 4/2010 |
| EP | 2202383 | A1 | 6/2010 |
| GB | 2365041 | A | 2/2000 |
| RU | 1740635 | A1 | 6/1992 |
| RU | 1758207 | A1 | 8/1992 |
| WO | 9857029 | A1 | 12/1998 |
| WO | 2004104370 | | 12/2004 |

OTHER PUBLICATIONS

*Brown Oil Tools—Liner Packers Catalog*, pp. 41-52.

J. Mota et al., *Drilling in with Expandable Liner Hangers*, E&P (Jun. 2006).

P. Fischer et al., *Suppliers Show Progress in Expandables Innovation*, World Oil (Jul. 2006).

P. Hazel, *Field Deployment of an Expandable Liner Hanger for 7¾" Casing Directional Drilling on a North Sea Well*, Bergen SPE One-Day Conference (Apr. 18, 2007).

*TORXS New Generation Expandable Liner Hanger System*, Baker Hughes Incorporated (Apr. 2009).

*VersaFlex® Liner Hanger System*, www.halliburton.com/ . . . (Apr. 8, 2008).

PCT International Search Report and Written Opinion, Dec. 9, 2010, Int'l Application No. PCT/US2010/000911, European Patent Office (International Searching Authority) (17 pp).

* cited by examiner

METHODS AND APPARATUS FOR CEMENTING WELLS

This nonprovisional application claims priority of prior nonprovisional application of Michael J. Harris and Martin Alfred Stulberg, entitled "Hydraulic Setting Assembly," U.S. Ser. No. 12/658,226, filed Feb. 4, 2010, which is a continuation in part of application of Michael J. Harris and Martin Alfred Stulberg, entitled "Anchor Assembly," U.S. Ser. No. 12/592,026, filed Nov. 19, 2009, both of which prior applications claim priority of provisional application of Michael J. Harris and Marty Stulberg, entitled "Anchoring Device," U.S. Ser. No. 61/166,169, filed Apr. 2, 2009.

FIELD OF THE INVENTION

The present invention relates to methods and tools for cementing liners in oil and gas wells and, more particularly, methods and tools for hanging, sealing, and cementing liners in a single downhole trip.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer, and thus, the porous layer forms a reservoir in which hydrocarbons are able to collect. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections referred to as a drill string. The drill string is suspended from a derrick and rotated by a motor in the derrick. A drilling fluid or "mud" is pumped down the drill string, through the bit, and into the wellbore. This fluid serves to lubricate the bit and carry cuttings from the drilling process back to the surface. As the drilling progresses downward, the drill string is extended by adding more pipe sections. When the drill bit has reached the desired depth, larger diameter pipes, or casings, are placed in the well and cemented in place to prevent the sides of the borehole from caving in. Cement is introduced through a work string. As it flows out the bottom of the work string, fluids already in the well, so-called "returns," are displaced up the annulus between the casing and the borehole and are collected at the surface.

Once the casing is cemented in place, it is perforated at the level of the oil bearing formation so oil can enter the cased well. If necessary, various completion processes are performed to enhance the ultimate flow of oil from the formation. The drill string is withdrawn and replaced with a production string. Valves and other production equipment are installed in the well so that the hydrocarbons may flow in a controlled manner from the formation, into the cased well bore, and through the production string up to the surface for storage or transport.

This simplified drilling process, however, is rarely possible in the real world. For various reasons, a modern oil well will have not only a casing extending from the surface, but also one or more pipes, i.e., casings, of smaller diameter running through all or a part of the casing. When those "casings" do not extend all the way to the surface, but instead are mounted in another casing, they are referred to as "liners." Regardless of the terminology, however, in essence the modern oil well typically includes a number of tubes wholly or partially within other tubes.

Thus, many wells today are drilled in stages. An initial section is drilled, cased, and cemented. Drilling then proceeds and a liner is run into the uncased portion of the well and installed. More specifically, the liner is suspended from the original casing by an anchor or "hanger." A seal also is typically established between the liner and the casing and, like the original casing, the liner is cemented in the well. That process then may be repeated to further extend the well and install additional liners.

Conventional liner anchors or "hangers" have included various forms of mechanical slip mechanisms that are connected to the liner. The slips themselves typically are in the form of cones or wedges having teeth or roughened surfaces. An installation tool is used to position the anchor in place and drive the slips from their initial, unset position, into a set position where they are able to bite into and engage the existing casing. The setting mechanisms typically are either hydraulic, which are actuated by increasing the hydraulic pressure within the tool, or mechanical, which are actuated by rotating, lifting, or lowering the tool, or some combination thereof. Those types of mechanical hangers typically require a separate annular seal or "packer" in order to seal the liner to the casing.

One approach to avoiding the need for separate packers and other problems attendant to mechanical hangers has been to eliminate in a sense the anchor entirely. That is, instead of using a separate anchor assembly, a portion of the liner itself is expanded into contact with an existing casing, making the liner essentially self-supporting and self-sealing. Such expandable liners, also commonly referred to as expandable hangers and expandable liner hangers, are made of sufficiently ductile metal to allow radial expansion of the liner, or more commonly, a portion of the liner into contact with existing casing. Various mechanisms, both hydraulic and mechanical, are used to expand the liner. Such approaches, however, all rely on direct engagement of, and sealing between the expanded liner and the existing casing.

For example, U.S. Pat. No. 7,225,880 to B. Braddick discloses an expandable liner. The liner is set within the casing by actuating an expander that radially expands the upper portion of the liner into engagement with a casing. Once expanded, the expanded portion of the liner provides a seal that prevent fluids from flowing between the liner and casing. The tubular expander is not withdrawn from the liner after the expandable portions have been expanded. It is designed to remain in the liner and provide radial support for the expanded liner.

U.S. Pat. No. 7,387,169 to S. Harrell et al. also discloses various methods of hanging liners and tying in production tubes by expanding a portion of the tubular via, e.g., a rotating expander tool. All such methods rely on creating direct contact and seals between the expanded portion of the tubular and the existing casing.

Such approaches have an advantage over traditional mechanical hangers. The external surface of the liner has no projecting parts and generally may be run through existing conduit more reliably than mechanical liner hangers. Moreover, the expanded liner portion not only provides an anchor for the rest of the liner, but it also creates a seal between the liner and the existing casing, thus reducing the need for a separate packer. Nevertheless, they suffer from significant drawbacks.

First, because part of it must be expandable, the liner necessarily is fabricated from relatively ductile metals. Such metals typically have lower yield strengths, thus limiting the amount of weight and, thereby, the length of liner that may be supported in the existing casing. Shorter liner lengths, in deeper wells, may require the installation of more liner sections, and thus, significantly greater installation costs. This problem is only exacerbated by the fact that expansion creates a weakened area between the expanded portion and the unexpanded portion of the liner. This weakened area is a potential failure area which can damage the integrity of the liner.

Second, it generally is necessary to expand the liner over a relatively long portion in order to generate the necessary grip on the existing casing. Because it must be fabricated from relatively ductile metal, once expanded, the liner portion tends to relax to a greater degree than if the liner were made of harder metal. This may be acceptable when the load to be supported is relatively small, such as a short patch section. It can be a significant limiting factor, however, when the expanded liner portion is intended to support long, heavy liners.

Thus, some approaches, such as those exemplified by Braddick '880, utilize expanders that are left in the liner to provide radial support for the expanded portion of the liner. Such designs do offer some benefits, but the length of liner which must be expanded still can be substantial, especially as the weight of the liner string is increased. As the length of the area to be expanded increases the forces required to complete the expansion generally increase as well. Thus, there is progressively more friction between the expanding tool and the liner being expanded and more setting force is required to overcome that increasing friction. The need for greater setting forces over longer travel paths also can increase the chances that liner will not be completely set.

Moreover, the liner necessarily must have an external diameter smaller than the internal diameter of the casing into which it will be inserted. This clearance, especially for deep wells where a number of progressively smaller liners will be hung, preferably is as small as possible so as to allow the greatest internal diameter for the liner. Nevertheless, if the tool is to be passed reliably through existing casing, this clearance is still relatively large, and therefore, the liner portion is expanded to a significant degree.

Thus, it may not be possible to fabricate the liner from more corrosion resistant alloys. Such alloys typically are harder and less ductile. In general, they may not be expanded, or expanded only with much higher force, to a degree sufficient to close the gap and grip the existing casing.

Apart from, and partially because of those shortcomings, expandable liners also create tradeoffs in cementing the liner. Because they establish a seal between the liner and existing casing, once an expandable liner is fully set fluids displaced up the annulus as cement is injected, the so-called "returns," can no longer flow around the liner on their way to the surface. Thus, some expandable liners, such as those disclosed in Braddick '880, are not set until after cementing has been completed.

Other expandable liners partially expand the liner in such a way as to leave vertical return flow paths between the liner and casing. For example, U.S. Pat. No. 7,441,606 to P. Maguire, U.S. Pat. No. 7,048,065 to R. Badrak et al., and U.S. Pat. No. 6,598,677 to J. Baugh disclose expandable liners which are expanded in two stages. In the first stage, the liner is partially expanded so as to engage a casing wall, but not completely seal the annulus around the liner. Vertical flow paths are left to allow returns from a cementing operation to flow around the liner to the casing above. After cementing is complete, the liner is fully expanded around its entire circumference and a separate annular seal is set.

Other expandable liners, such as liners disclosed in Baugh '677, are partially expanded to create an initial seal before cementing. A flow path for returns is created by providing a port in the expandable liner and passageways through the swage which is used to expand the liner. The swage remains engaged with the liner, and returns entering the liner through the port flow through the passageways in the swage. When the cementing operation is concluded, the swage is actuated to finish expanding the liner, including the area around the port, thus sealing off the port.

Baugh '677 also discloses a similar hanger where, instead of sealing the port by expanding the liner around it, a slidable cover is provided on the exterior of the liner. The cover is actuated to shut the port after cementing has been completed, but there is no disclosure of any mechanism or method of doing so. In any event, the swage remains engaged with the liner and is not withdrawn until after cementing is complete and the port is shut.

All of those approaches suffer from a common deficiency. That is, the swage or other mechanisms by which the liner is expanded and the hanger is set and sealed are not disengaged until after cementing has been completed. In most instances, setting and sealing of the liner also is not completed until after the liner is cemented. Cementing the liner before it has been fully set, however, has its own set of problems. Most significantly, it means that the liner will be cemented in place before an operator knows that the setting mechanism has operated properly, that an effective seal has been established with existing casing, and that he is able to retrieve the tools used to install the liner. Any difficulties in those operations usually are more easily overcome if the liner has not been cemented.

Moreover, even where it is possible to establish a seal, the manner in which flow paths for returns are established in conventional expandable liners leaves much to be desired. The fabrication and assembly of the installation tool is unnecessarily complicated by any need to provide passages in the swage or other tool components. Moreover, because they are made from relatively ductile metals, expandable liners already suffer from various weak points and potential failure areas as discussed above. Providing ports through an expandable liner exacerbates that problem.

Another reality facing the oil and gas industry is that most of the known shallow reservoirs have been drilled and are rapidly being depleted. Thus, it has become necessary to drill deeper and deeper wells to access new reserves. Many operations, such as installing a liner, can be practiced with some degree of error at relatively shallow depths. Similarly, the cost of equipment failure is relatively cheap when the equipment is only a few thousand feet from the surface.

When the well is designed to be 40,000 feet or even deeper, such failures can be costly in both time and expense. Apart from capital expenses for equipment, operating costs for modern offshore rigs can be $500,000 or more a day. There is a certain irony too in the fact that failures are not only more costly at depth, but that avoiding such failures is also more difficult. Temperature and pressure conditions at great depths can be extreme, thus compounding the problem of designing and building tools that can be installed and will function reliably and predictably.

The increasing depth of oil wells also means that the load capacity of a connection between an existing casing and a liner, whether achieved through mechanical liner hangers or expanded liners, is increasingly important. Higher load capacities may mean that the same depth may be reached with fewer liners. Because operational costs of running a drilling rig can be so high, significant cost savings may be achieved if the time spent running in an extra liner can be avoided.

Ever increasing operational costs of drilling rigs also has made it increasingly important to combine operations so as to reduce the number of trips into and out of a well. For example, especially for deep wells, significant savings may be achieved by drilling and lining a new section of the well at the same time. Thus, tools for setting liners have been devised which will transmit torque from a work string to a liner. A drill bit is attached to the end of the liner, and the liner is rotated.

Such disadvantages and others inherent in the prior art are addressed by the subject invention, which now will be described in the following detailed description and the appended drawings.

SUMMARY OF THE INVENTION

The subject invention provides for novel hydraulic actuators and hydraulic setting assemblies which may be used in downhole, oil and gas well tools. The novel hydraulic actuators include a cylindrical mandrel and an annular stationary sealing member connected to the mandrel. A hydraulic cylinder is slidably supported on the mandrel and stationary sealing member and is releasably fixed in position on the mandrel. The stationary sealing member divides the interior of the cylinder into a bottom hydraulic chamber and a top hydraulic chamber. An inlet port provides fluid communication into the bottom hydraulic chamber, and an outlet port provides fluid communication into the top hydraulic chamber.

The novel actuators further include a balance piston. The balance piston is slidably supported within the top hydraulic chamber of the actuator, preferably on the mandrel. The balance piston includes a passageway extending axially through the balance piston. Fluid communication through the piston and between its upper and lower sides is controlled by a normally shut valve in the passageway. Thus, in the absence of relative movement between the mandrel and the cylinder, the balance piston is able to slide in response to a difference in hydrostatic pressure between the outlet port, which is on one side of the balance piston, and the portion of the top hydraulic chamber that is on the bottom side of the balance piston. The novel actuators, therefore, are less susceptible to damage caused by differences in the hydrostatic pressure inside and outside of the actuator. Moreover, the balance piston of the novel actuators is able to prevent the ingress of debris into the actuator.

The normally shut valve in the novel actuators preferably is a rupturable diaphragm. Other preferred embodiments include a pressure release device allowing controlled release of pressure from the top hydraulic cylinder.

In other aspects, the subject invention provides for anchor assemblies that are intended for installation within an existing conduit. The novel anchor assemblies comprise a nondeformable mandrel, an expandable metal sleeve, and a swage. The expandable metal sleeve is carried on the outer surface of the mandrel. The swage is supported for axial movement across the mandrel outer surface from a first position axially proximate to the sleeve to a second position under the sleeve. The movement of the swage from the first position to the second position expands the sleeve radially outward into contact with the existing conduit.

Preferably, the swage of the novel anchor assemblies has an inner diameter substantially equal to the outer diameter of the mandrel and an outer diameter greater than the inner diameter of the expandable metal sleeve. The mandrel of the novel anchor assemblies preferably is fabricated from high yield metal alloys and, most preferably, from corrosion resistant high yield metal alloys.

The novel anchor assemblies preferably have a load capacity of at least 100,000 lbs, more preferably, a load capacity of at least 250,000 lbs, and most preferably a load capacity of at least 500,000 lbs. The novel anchors thus are able to support the weight of liners and other relative heavy downhole tools and well components.

The novel anchor assemblies are intended to be used in combination with a tool for installing the anchor in a tubular conduit. The anchor and tool assembly comprises the anchor assembly, a running assembly, and a setting assembly. The running assembly releasably engages the anchor assembly. The setting assembly is connected to the running assembly and engages the swage and moves it from its first position to its second position.

As will become more apparent from the detailed description that follows, once the sleeve is expanded, the mandrel and swage provide radial support for the sleeve, thereby enhancing the load capacity of the novel anchors. Conversely, by enhancing the radial support for the sleeve, the novel anchors may achieve, as compared to expandable liners, equivalent load capacities with a shorter sleeve, thus reducing the amount of force required to set the novel anchors. Moreover, unlike expandable liners, the mandrel of the novel anchor assemblies is substantially nondeformable and may be made from harder, stronger, more corrosion resistant metals.

In yet other aspects the subject invention provides for novel clutch mechanisms which may be and preferably are used in the mandrel of the novel anchor and tool assemblies and in other sectioned conduits and shafts used to transmit torque. They comprise shaft sections having threads on the ends to be joined and prismatic outer surfaces adjacent to their threaded ends. A threaded connector joins the threaded ends of the shaft sections. The connector has axial splines. A pair of clutch collars is slidably supported on the prismatic outer surfaces of the shaft sections. The clutch collars have prismatic inner surfaces that engage the prismatic outer surfaces of the shaft sections and axial splines that engage the axial splines on the threaded connector. Preferably, the novel clutch mechanisms also comprise recesses adjacent to the mating prismatic surfaces that allow limited rotation of the clutch collars on the prismatic shaft sections to facilitate engagement and disengagement of the mating prismatic surfaces. Thus, as will become more apparent from the detailed description that follows, the novel clutch mechanisms provide reliable transmission of large amounts of torque through sectioned conduits and other drive shafts without damaging the threaded connections.

Yet other aspects of the subject invention provide for novel methods of installing and cementing a liner in a well, novel flow diverters, and novel liner assemblies. One such embodiment provides a method for installing and cementing a liner in a well. The method comprises running the liner into the well on a work string, anchoring the liner to an existing casing in the well, and sealing the liner to the existing casing. The seal substantially prevents direct fluid flow around the liner to the existing casing from the annulus between the liner and the well. The liner then is released from the work string and the work string raised to provide a flow path inside the liner. Cement is injected into the liner and allowed to flow into the annulus. Fluid displaced from the annulus by the cement is returned through a port in the liner, the port being disposed downhole of the seal, and via the flow path established by the releasing of the liner and the raising of the work string. The work string then is pulled out of the well.

Other embodiments provide methods for installing and cementing a liner in a well wherein a liner assembly is run into the well. The liner assembly comprises a tubular liner and an anchor connected to the liner. The anchor is in an unset position in which fluid is able to flow around the liner assembly in the annulus between the liner assembly and the well. The liner assembly further comprises an installation tool releasably engaging the anchor, a return flow diverter connected to the liner below the anchor and having a port allowing fluid communication from the annulus into the flow diverter, and a tubular conduit extending through the anchor, installation tool, and the flow diverter and into the liner.

The installation tool is actuated to set the anchor to secure and seal the liner in an existing casing of the well and thereby substantially preventing direct fluid flow around the liner assembly from the annulus to the existing casing. The installation tool then is disengaged and raised away from the anchor to provide a path for fluid flow through the anchor and around the conduit and cement is injected through the conduit into the liner and annulus. Fluid displaced by the cement is allowed to flow from the annulus into the existing casing via the diverter port and the path provided by the disengaging and raising the installation tool.

Yet other aspects of the invention provide methods for installing a liner in a well which comprise running a liner assembly into the well. The liner assembly comprises a tubular liner and an anchor connected to the liner, the anchor being in an unset position in which fluid is able to flow around the liner assembly in the annulus between the liner assembly and the well. The liner assembly also comprises an installation tool releasably engaging the anchor, a return flow diverter connected to the liner below the anchor and having a port allowing fluid communication from the annulus into the flow diverter, a tubular conduit extending through the anchor, installation tool, and the flow diverter and into the liner; and a one-way seal mounted between the tubular conduit and the liner or the flow diverter above the flow diverter port. The one-way seal allows fluid flow upward through the one-way seal and prevents fluid flow downward past the one-way seal.

The installation tool is actuated to set the anchor, the anchor securing and sealing the liner in an existing casing of the well and thereby substantially preventing direct fluid flow around the liner assembly from the annulus to the existing casing. The seal established by setting the anchor then is pressure tested.

Other embodiments provide a return flow diverter adapted to allow return flow during cementing of a liner for a well. The return flow diverter comprises a cylindrical body adapted for installation in a well as part of the liner. The cylindrical body has a fluid port therein adapted to allow fluids displaced by a cementing operation to flow from an annulus between the liner and the well into the cylindrical body. The return flow diverter also comprises a cover supported on the cylindrical body for movement from an open position, in which the port is open, to a closed position, in which the port is closed by the cover, a transmission disposed within the cylindrical body and defining a cylindrical passageway adapted to accommodate a tubular conduit. The tubular conduit is adapted to extend through the cylindrical body and inject cement into the liner below the body and the transmission is releasably connected to the cover and operable to move the cover from the open position to the closed position. Other aspects of the invention provide novel liner assemblies comprising such return flow diverters and further comprising an anchor adapted to secure the liner assembly in the well and having an unset position in which fluid is able to flow around the liner assembly when the liner assembly is run into a well, and an installation tool releasably engaging the anchor and adapted to set the anchor in an existing casing of the well.

Still other embodiments of the invention provide for a liner assembly for allowing return flow during cementing of the liner assembly in a well. The liner assembly comprises an anchor adapted to secure and seal the liner assembly in the well. The anchor comprises a nondeformable cylindrical mandrel, an expandable metal sleeve carried on the outer surface of the mandrel, and a cylindrical swage supported for axial movement across the mandrel outer surface from a first position axially proximate to the sleeve to a second position under the sleeve; wherein the movement of the swage expands the sleeve radially outward and anchors and seals the liner assembly to an existing casing in the well. The liner assembly further comprises an installation tool releasably engaging the anchor and adapted to actuate the swage and a flow diverting tool. The flow diverting tool has a cylindrical body defining a port adapted to allow fluids displaced by a cementing operation to flow from an annulus between the liner and the well into the tool, a cover mounted on the body, the cover movable from an open position, in which the port is open, to a closed position, in which the port is closed, and a transmission operable to move the cover from the open position to the closed position.

Those and other aspects of the invention, and the advantages derived therefrom, are described in further detail below.

Figure 1A:
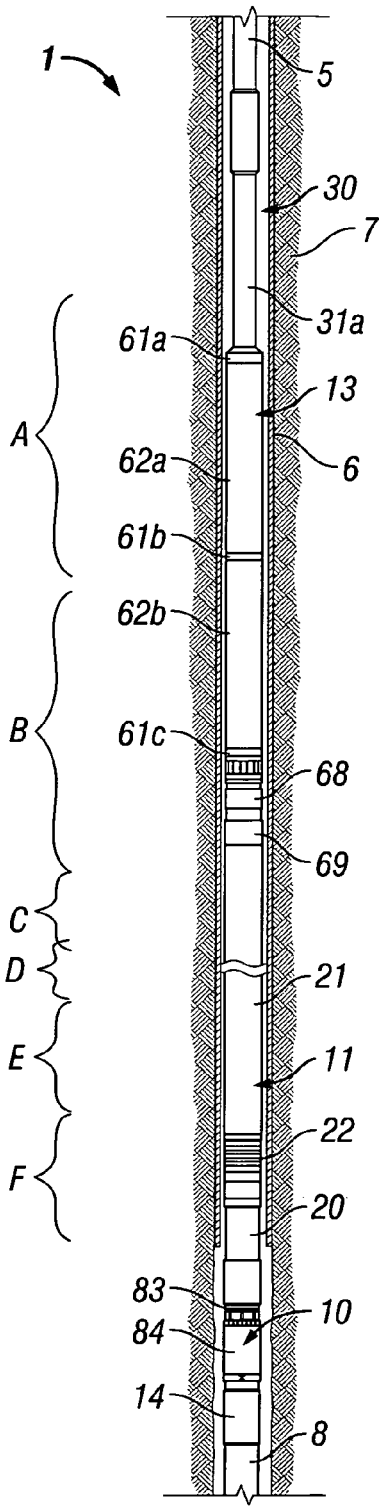
FIG. 1A is a perspective view of a preferred embodiment 1 of the liner assemblies of the subject invention, including preferred embodiment 2 of the novel liners connected to preferred embodiment 3 of the novel anchor installation tools, liner assembly 1 being at depth in an existing casing 6 (shown in cross-section)

Those skilled in the art will appreciate that line breaks along the vertical length of the tool may eliminate well known structural components or inter connecting members, and accordingly the actual length of structural components is not represented.

DESCRIPTION OF ILLUSTRATIVE EMBODIMENTS

The liner assemblies of the subject invention may be used to install novel liners within an existing conduit. They generally comprise liner tubulars, an anchor connected to the liner tubulars, an installation tool releasably engaging the anchor, and a return flow diverter. Other embodiments comprise a tubular conduit extending through the anchor, installation tool, and flow diverter, novel anchors, and novel return flow diverters.

The novel methods of installing and cementing liners in a well generally comprise running a liner into the well on a work string. The liner is anchored and sealed to an existing casing in the well. The liner then is released, and the work string is raised to provide a flow path inside the liner. Cement is injected into the liner and allowed to flow into the annulus between the liner and the well. Since the liner has been sealed to the existing casing, fluid displaced from the annulus by the cement is substantially prevented from flowing around the liner to the existing casing. Thus, return fluids are allowed to flow through a port in the liner and the fluid path that was provided by releasing the liner and raising the work string. After the desired amount of cement has been injected into the annulus, the work string is pulled out of the well.

Other novel methods of installing and cementing liners generally comprise running a liner assembly into a well. The liner assembly comprises liner tubulars and an anchor. The anchor is in an unset position in which fluid is able to flow around the liner assembly. The liner assembly also comprises an installation tool releasably engaging the anchor and a return flow diverter connected to the liner below the anchor. The return flow diverter has a port allowing fluid communication from the annulus between the liner and the well to the interior of the diverter. The liner assembly further comprises a tubular conduit which extends through the anchor, installation tool, and flow diverter into the liner.

Once the liner assembly is run into the well, the installation tool is actuated to set the anchor which in turn secures and seals the liner in an existing casing of the well. Once the anchor is set and the seal established, fluid is substantially prevented from flowing directly around the liner assembly from the annulus below the anchor to the existing casing above the anchor. The installation tool then is disengaged and raised away from the anchor to provide a path for fluid flow through the anchor and around the conduit. Once the installation tool is disengaged, cement is injected through the conduit into the liner and annulus. Well fluid displaced by the cement then is able to flow from the annulus into the existing casing via the diverter port and the path provided by disengagement and raising of the installation tool.

The anchors of the subject invention are intended for installation within an existing conduit. They comprise a nondeformable mandrel, an expandable metal sleeve, and a swage. The expandable metal sleeve is carried on the outer surface of the mandrel. The swage is supported for axial movement across the mandrel outer surface from a first position axially proximate to the sleeve to a second position under the sleeve. The movement of the swage from the first position to the second position expands the sleeve radially outward into contact with the existing conduit.

The novel anchors are intended to be used in combination with a tool for installing the anchor in a tubular conduit. The installation tool comprises a running assembly and a setting assembly. The running assembly releasably engages the anchor. The setting assembly is connected to the running assembly and engages the swage and moves it from its first position to its second position.

The anchor and installation tool assembly, collectively referred to as the liner hanger tool, is used, for example, in drilling oil and gas wells and to install liners and other well components. It is connected to a work string, preferably as part of a liner assembly, which can be raised, lowered, and rotated as desired from the surface of the well. A liner or other well component may be attached to the liner hanger tool. If a liner is attached, the liner preferably includes a port allowing return fluids from cementing operations to enter the liner. Most preferably, the liner assembly comprises a novel return flow diverter.

The liner assembly then is lowered into the well through an existing conduit to position the anchor at the desired depth. Once the anchor is in position, the swage is moved axially over the mandrel outer surface by a setting assembly. More particularly, the swage is moved from a position proximate to the expandable metal sleeve to a position under the sleeve, thereby expanding the sleeve radially outward into contact with the existing conduit. Once the metal sleeve has been expanded, the tool is manipulated to release the running assembly from the anchor assembly. Preferably, as described below, the anchor is set and released before the liner is cemented in the well. In any event, the running and setting assemblies ultimately are retrieved from the conduit to complete installation of the liner or other well component.

For example, FIG. 1A shows a preferred liner assembly 1 of the subject invention. Liner assembly 1 includes a preferred embodiment 11 of the novel liner hangers which is connected to an installation tool 3. Tool 3 is connected at its upper end to a work string 5 assembled from multiple lengths of tubular sections threaded together through connectors. Work string 5 may be raised, lowered, and rotated as needed to transport liner assembly 1 through an existing casing 6 cemented in a borehole through earth 7. Work string 5 also is used to pump fluid into liner assembly 1 and to manipulate it as required for setting hanger 11.

Preferred liner assembly 1 also includes a liner 2 which is attached to the lower end of hanger 11. Liner 2 is assembled primarily from multiple lengths of tubular sections, such as liner tubular 8, threaded together through connectors. Liner assembly 1, as it is run into a well, also typically will have various other tools and components as may be need to perform various operations in the well, both before and after setting hanger 11.

For example, liner 2 will be cemented in place and, therefore, liner assembly 1 incorporates various tools and components used to perform cementing operations, such as a preferred embodiment 10 of the return flow diverters of the subject invention, cement packoff 14, a slick joint 15, and a liner wiper plug (not shown). Operation of installation tool 3, as discussed in detail below, is accomplished in part by increasing hydraulic pressure within tool 3. Thus, liner assembly 1 also preferably incorporates a mechanism to allow pressure to be built up in work string 5, such as a ball seat (not shown) onto which a ball may be dropped. Importantly, liner assembly 1 also may include a drill bit (not shown) so that the borehole may be drilled and extended as liner assembly 1 is lowered through existing casing 6.

It will be understood that references to a liner assembly includes the entire collection of tools and tubulars that are run into the well on a work string and manipulated to install a liner. In that context, references to liner 2 or to a liner generally refer to the liner tubulars, such as tubulars 8, that constitute the major portion of its length and may include, as the context dictates, other unreferenced components. On the other hand, it will be appreciated that when a liner is installed many, but not all of the tools and components that were used to install the liner are extracted from or drilled out of the well. For example, installation tool 3 will be completely pulled from the well at some point after anchor 11 has been set. Other tools or parts thereof, however, such as liner hanger 11, remain in the well and form part of the conduit that constitutes and is referred to in this sense as the liner. Thus, references to liner 2 or an installed liner generally include not only the liner tubulars, but also those tools or components of a liner assembly that remain in the well after completion of the operations described herein and constitute part of the overall liner conduit. While some imprecision is inevitable, it is believed workers of ordinary skill in the art will readily understand such references in the context in which they are used.

Hanger Assembly

Hanger 11 includes a hanger mandrel 20, a swage 21, and a metal sleeve 22. Liner 2 is attached to the lower end of hanger 11, more specifically to hanger mandrel 20.

It will be appreciated, however, that while their design and operation are described in reference to liner assembly 1, the anchors and installation tools of the subject invention are not limited in their application to any specific liner assemblies or a liner. The novel anchors may be used to install a variety of liners, and in general, may be used to install any other downhole tool or component that requires anchoring within a conduit, such as whipstocks, packers, bridge plugs, cement plugs, frac plugs, slotted pipe, and polished bore receptacles (PBRs). Similarly, while preferred liner assembly 1 is exemplified by showing a liner suspended in tension from hanger 11, the novel anchors may also be used to support liners or other well components extending above the anchor, or to secure such components in resistance to torsional forces.

Moreover, as used in industry, a "casing" is generally considered to be a tubular conduit lining a well bore and extending from the surface of the well. Likewise, a "liner" is generally considered to be a tubular conduit lining a well bore that does not extend from the surface of the well, and instead is supported within an existing casing or another liner. In the context of the subject invention, however, it shall be understood that "casing" shall refer to any existing conduit in the well into which the anchor assembly will be installed, whether it extends to the surface or not, and "liner" shall refer to a conduit having an external diameter less than the internal diameter of the casing into which the anchor is installed.

Even more broadly, it will be appreciated that the novel tools will be exemplified in the context of casings and liners used in drilling oil and gas wells. The invention, however, is not so limited in its application. The novel tools and anchors may be used advantageously in other conduits where it is necessary to install an anchor by working a tool through an existing conduit to install other tools or smaller conduits.

It also will be appreciated that the figures and description refer to liner assembly 1 as being vertically oriented. Modern wells, however, often are not drilled vertically and, indeed, may extend horizontally through the earth. The novel tools, anchors, and liner assemblies also may be used in horizontal wells. Thus, references to up, down, upward, downward, above, below, upper, lower, and the like shall be understood as relative terms in that context.

Figure 1B:
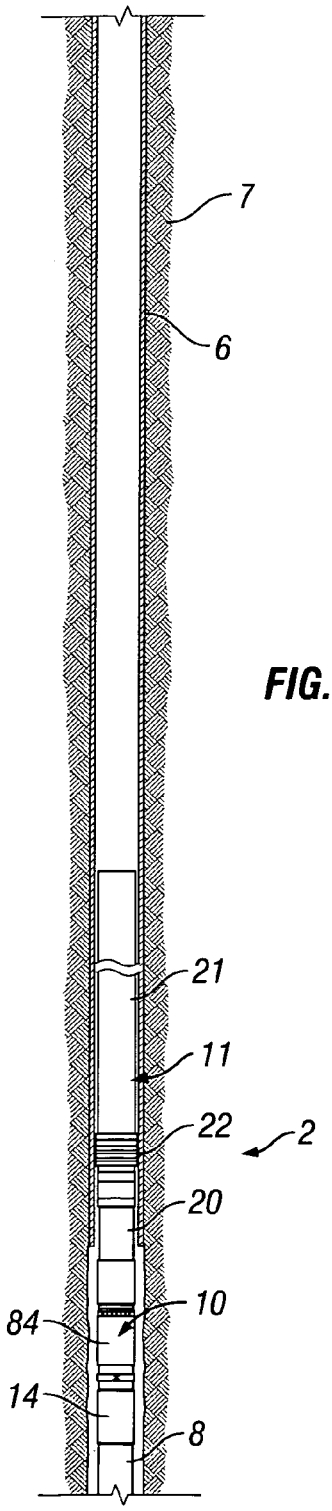
FIG. 1B is a perspective view similar to FIG. 1A showing preferred liner 2 of the subject invention after it has been set in casing 6 by anchor installation tool 3 and installation tool 3 has been retrieved from casing 6.

In FIG. 1A, liner assembly 1 is shown in its "run-in" position. That is, it has been lowered into existing casing 6 to the depth at which hanger 11 will be installed. Hanger 11 has not yet been "set" in casing 6, that is, it has not been installed. FIG. 1B shows liner 2 after it has been installed, that is, after hanger 11 has been set in casing 6 and a running tool 12 (not shown) and setting tool 13 have been retrieved from the well. It will be noted in comparing the two figures that hanger mandrel 20 has remained in substantially the same position relative to casing 6, that swage 21 has travelled downward approximately the length of sleeve 22, and that sleeve 22 has been expanded radially outward into contact with casing 6.

Further details regarding liner hanger 11 may be seen in FIG. 7, which show liner hanger 11 and various components of running tool 12. FIG. 7A shows hanger 11 in its "run-in" position, FIG. 7B shows hanger 11 after it has been "set," FIG. 7C shows hanger 11 after it has been "released" from running tool 12, and FIG. 7D shows hanger 11 after running tool 12 has been partially withdrawn from hanger 11.

As may be seen therefrom, hanger mandrel 20 is a generally cylindrical body providing a conduit. It provides a connection at its lower end to, e.g., a liner string (such as liner 2 shown in FIG. 1) through threaded connectors or other conventional connectors. Other liners, such as a patch liner, and other types of well components or tools, such as a whipstock, however, may be connected to mandrel 20, either directly or indirectly. Thus, while described herein as part of liner hanger 11, it also may be viewed as the uppermost component of the liner or other well component that is being installed. As will be described in further detail below, mandrel 20 also is releasably engaged to running tool 12.

Figure 7A:
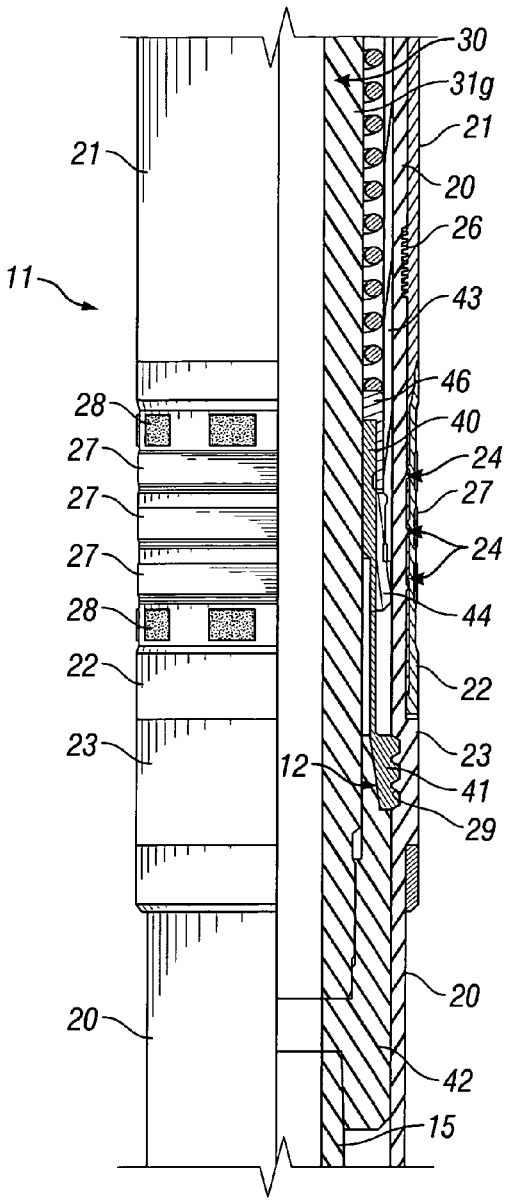
FIG. 7A is an enlarged quarter-sectional view generally corresponding to section F of liner assembly 1 shown in FIG. 1A showing additional details of liner hanger 11 and running tool 12 in their run-in position.

As may be seen from FIG. 7A, in the run-in position the upper portion of mandrel 20 provides an outer surface on which are carried both swage 21 and expandable metal sleeve 22. Swage 21 and expandable metal sleeve 22, like mandrel 20, also are generally cylindrical bodies.

Swage 21 is supported for axial movement across the outer surface of mandrel 20. In the run-in position, it is proximate to expandable metal sleeve 22, i.e., it is generally axially removed from sleeve 22 and has not moved into a position to expand sleeve 22 into contact with an existing casing. In theory it may be spaced some distance therefrom, but preferably, as shown in FIG. 7A, swage 21 abuts metal sleeve 22. Sleeve 22 also is carried on the outer surface of mandrel 20. Preferably, sleeve 22 is restricted from moving upward on mandrel 20 by swage 21 as shown and restricted from moving downward by its engagement with annular shoulder 23 on mandrel 20. It may be restricted, however, by other stops, pins, keys, set screws and the like as are known in the art.

By comparing FIG. 7A and FIG. 7B, it may be seen that hanger 11 is set by actuating swage 21 as will be described in greater detail below. When it is actuated, swage 21 moves across the outer surface of mandrel 20 from its run-in position, where it is proximate to sleeve 22, to its set position, where it is under sleeve 22. This downward movement of swage 21 causes metal sleeve 22 to expand radially into contact with an existing casing, such as casing 6 shown in FIG. 1 and FIG. 7D.

Movement of swage 21 under sleeve 22 preferably is facilitated by tapering the lower end of swage 21 and the upper end of sleeve 22, as seen in FIG. 7A. Preferably, the facing surfaces of mandrel 20, swage 21, and sleeve 22 also are polished smooth and/or are provided with various structures to facilitate movement of swage 21 and to provide seals therebetween. For example, outer surface of mandrel 20 and inner surface of sleeve 22 are provided with annular bosses in the areas denoted by reference numeral 24. Those bosses not only reduce friction between the facing surfaces as swage 21 is being moved, but when swage 21 has moved into place under sleeve 22, though substantially compressed and/or deformed, they also provide metal-to-metal seals between mandrel 20, swage 21, and sleeve 22. It will be understood, however, that annular bosses may instead be provided on the inner and outer surfaces of swage 21, or on one surface of swage 21 in lieu of bosses on either mandrel 20 or sleeve 22. Coatings also may be applied to the facing surfaces to reduce the amount of friction resisting movement of swage 21 or to enhance the formation of seals between facing surfaces.

The outer surface of swage 21, or more precisely, that portion of the outer surface of swage 21 that will move under sleeve 22 preferably is polished smooth to reduce friction therebetween. Likewise, the inner surface of swage 21 preferably is smooth and polished to reduce friction with mandrel 20. Moreover, once hanger 11 is installed in an existing casing, the upper portion of swage 21 is able to provide a polished bore receptacle into which other well components may be installed.

Preferably, the novel anchor assemblies also include a ratchet mechanism that engages the mandrel and swage and resists reverse movement of the swage, that is, movement of the swage back toward its first position, in which it is axially proximate to the sleeve, and away from its second position, where it is under the sleeve. Liner hanger 11, for example, is provided with a ratchet ring 26 mounted between mandrel 20 and swage 21. Ratchet ring 26 has pawls that normally engage corresponding detents in annular recesses on, respectively, the outer surface of mandrel 20 and the inner surface of swage 21. Ratchet ring 26 is a split ring, allowing it to compress circumferentially, depressing the pawls and allowing them to pass under the detents on swage 21 as swage 21 travels downward in expanding sleeve 22. The pawls on ring 26 are forced into engagement with the detents, however, if there is any upward travel of swage 21. Thus, once set, relative movement between mandrel 20, swage 21, and sleeve 22 is resisted by ratchet ring 26 on the one hand and mandrel shoulder 23 on the other.

It will be appreciated from the foregoing that in the novel anchor assemblies, or at least in the area of travel by the swage, the effective outer diameter of the mandrel and the effective inner diameter of the swage are substantially equal, whereas the effective outer diameter of the swage is greater than the effective inner diameter of sleeve. Thus, for example and as may be seen in FIG. 7B, swage 21 acts to radially expand sleeve 22 and, once sleeve 22 is expanded, mandrel 20 and swage 21 concentrically abut and provide radial support for sleeve 22, thereby enhancing the load capacity of hanger 11. Conversely, by enhancing the radial support for sleeve 22, hanger 11 may achieve equivalent load capacities with a shorter sleeve 22, thus reducing the amount of force required to set hanger 11.

By effective diameter it will be understood that reference is made to the profile of the part as viewed axially along the path of travel by swage 21. In other words, the effective diameter takes into account any protruding structures such as annular bosses which may project from the nominal surface of a part. Similarly, when projections such as annular bosses are provided on mandrel 20 or swage 21, the outer diameter of mandrel 20 will be slightly greater than the inner diameter of swage 21 so that a seal may be created therebetween. "Substantially equal" is intended to encompass such variations, and other normal tolerances in tools of this kind.

Moreover, since hanger mandrel 20 is in a sense the uppermost component of liner 2 to be installed, it will be appreciated that its inner diameter preferably is at least as great as the inner diameter of liner 2 which will be installed. Thus, any further constriction of the conduit being installed in the well will be avoided. More preferably, however, it is substantially equal to the inner diameter of liner 2 so that mandrel 20 may be made as thick as possible.

It also will be appreciated that the mandrel of the novel anchor assemblies is substantially nondeformable, i.e., it resists significant deformation when the swage is moved over its outer surface to expand the metal sleeve. Thus, expansion of the sleeve is facilitated and the mandrel is able to provide significant radial support for the expanded sleeve. It is expected that some compression may be tolerable, on the order of a percent or so, but generally compression is kept to a minimum to maximize the amount of radial support provided. Thus, the mandrel of the novel anchors preferably is fabricated from relatively hard ferrous and non-ferrous metal alloys and, most preferably, from such metal alloys that are corrosion resistant. Suitable ferrous alloys include nickel-chromium-molybdenum steel and other high yield steel. Non-ferrous alloys include nickel, iron, or cobalt superalloys, such as Inconel, Hastelloy, Waspaloy, Rene, and Monel alloys. The superalloys are corrosion resistant, that is, they are more resistant to the chemical, thermal, pressure, and other corrosive conditions commonly encountered in oil and gas wells. Thus, superalloys or other corrosion resistant alloys may be preferable when corrosion of the anchor is a potential problem.

The swage of the novel anchors also is preferably fabricated from such materials. By using such high yield alloys, not only is expansion of the sleeve facilitated, but the mandrel and swage also are able to provide significant radial support for the expanded sleeve and the swage may be made more resistant to corrosion as well.

On the other hand, the sleeve of the novel anchor assemblies preferably is fabricated from ductile metal, such as ductile ferrous and non-ferrous metal alloys. The alloys should be sufficiently ductile to allow expansion of the sleeve without creating cracks therein. Examples of such alloys include ductile aluminum, brass, bronze, stainless steel, and carbon steel. Preferably, the metal has an elongation factor of approximately 3 to 4 times the anticipated expansion of the sleeve. For example, if the sleeve is required to expand on the order of 3%, it will be fabricated from a metal having an elongation factor of from about 9 to about 12%. In general, therefore, the material used to fabricate the sleeve should have an elongation factor of at least 10%, preferably from about 10 to about 20%. At the same time, however, the sleeve should not be fabricated from material that is so ductile that it cannot retain its grip on an existing casing.

It also will be appreciated that the choice of materials for the mandrel, swage, and sleeve should be coordinated to provide minimal deformation of the mandrel, while allowing the swage to expand the sleeve without creating cracks therein. As higher yield materials are used in the mandrel and swage, it is possible to use progressively less ductile materials in the sleeve. Less ductile materials may provide the sleeve with greater gripping ability, but of course will require greater expansion forces.

Significantly, however, by using a ductile, expandable metal seal, and a nondeformable mandrel, it is possible to provide a strong, reliable seal with an existing casing, while avoiding the complexities of other mechanical hangers and the significant disadvantages of expandable liners. More specifically, the novel hangers do not have a weakened area such as exists at the junction of expanded and unexpanded portions of expandable liners. Thus, other factors being equal, the novel hangers are able to achieve higher load ratings.

In addition, expandable liners must be made relatively thick in part to compensate for the weakened area created between the expanded and unexpanded portions. The expandable sleeves of the novel hangers, however, are much thinner. Thus, other factors being equal, the expandable sleeves may be expanded more easily, which in turn reduces the amount of force that must be generated by the setting assembly.

Ductile alloys, from which both conventional expandable liners and the expandable sleeves of the novel hangers may be made, once expanded, can relax and cause a reduction in the radial force applied to an existing casing. Conventional tools have provided support for expanded liner portions by leaving the swage or other expanding member in the well. The nondeformable mandrel of the novel liner hangers, however, has substantially the same outer diameter as the internal diameter of the swage. Thus, both the mandrel and the swage are able to provide radial support for the expanded sleeve. Other factors being equal, that increased radial support reduces "relaxation" of the expanded, relatively ductile sleeve and, in turn, tends to increase the load capacity of the anchor. At the same time, the mandrel is quite easily provided with an internal diameter at least as great as the liner which will be installed, thus avoiding any further constriction of the conduit provided through the well.

Expandable liner hangers, since they necessarily are fabricated from ductile alloys which in general are less resistant to corrosion, are more susceptible to corrosion and may not be used, or must be used with the expectation of a shorter service life in corrosive environments. The mandrel of the novel hangers, however, may be made of high yield alloys that are much more resistant to corrosion. The expandable sleeve of the novel hangers are fabricated from ductile, less corrosion resistant alloys, but it will be appreciated that as compared to a liner, only a relatively small surface area of the sleeve will be exposed to corrosive fluids. The length of the seal formed by the sleeve also is much greater than the thickness of a liner, expanded or otherwise. Thus, the novel hangers may be expected to have longer service lives in corrosive environments.

The expandable sleeve of the novel anchor assemblies also preferably is provided with various sealing and gripping elements to enhance the seal between the expanded sleeve and an existing casing and to increase the load capacity of the novel hangers. For example, as may be seen in FIG. 7, sleeve 22 is provided with annular seals 27 and radially and axially spaced slips 28 provided on the outer surface thereof. Annular seals may be fabricated from a variety of conventional materials, such as wound or unwound, thermally cured elastomers and graphite impregnated fabrics. Slips may be provided by conventional processes, such as by machining slips into the sleeve, or by soldering crushed tungsten-carbide steel or other metal particles to the sleeve surface with a thin coat of high nickel based solder or other conventional solders. When such seals and slips are used the sleeve also preferably is provided with gage protection to minimize contact between such elements and the casing wall as the anchor assembly is run into the well.

As will be appreciated by those skilled in the art, the precise dimensions of the expandable sleeve may be varied so as to, other factors being equal, to provide greater or lesser load capacity and to allow for greater or lesser expansion forces. The external diameter of the sleeve necessarily will be determined primarily by the inner diameter of the casing into which the anchor will be installed and the desired degree of expansion. The thickness of the sleeve will be coordinated with the tensile and ductile properties of the material used in the sleeve so as to provide the desired balance of load capacity and expandability. In general, the longer the sleeve, the greater the load capacity. Thus, the sleeve typically will have a length at least equal to its diameter, and preferably a length of at least 150% of the diameter, so as to provide sufficient surface area to provide load capacities capable of supporting relatively heavy liners and other downhole tools and well components. The novel anchor assemblies thus may be provided with load capacities of at least 100,000 lbs, more preferably, at least 250,000 lbs, and most preferably, at least 500,000 lbs.

Thus, the novel anchors of the subject invention provide significant advantages and preferably are used in practicing the novel methods for installing and cementing a liner in a well and in the novel liner assemblies. As will be appreciated from the discussion that follows, however, other hangers that provide a seal with an existing casing when they are set, or hangers with separate seal members may be used in the novel methods and the novel liner assemblies. For example, expandable liners such as those disclosed in Braddick '880, Harrell '169, and Baugh '667, which establish a seal with an existing casing as they are set, may be adapted for use in the subject invention. The expandable liner and overall liner weight will be coordinated so that the liner may be substantially supported and immobilized during the cementing process.

Clutch Mechanism

As noted above, the novel anchor assemblies are intended to be used in combination with a tool for installing the anchor in a tubular conduit. For example, installation tool 3 may be used to install liner hanger 11. More specifically, running tool 12 is used to releasably engage hanger 11 and setting tool 13 is used to actuate swage 21 and set sleeve 22. There are a variety of mechanisms which may be incorporated into tools to provide such releasable engagement and actuation. In this respect, however, the subject invention does not encompass any specific tool or mechanism for releasably engaging, actuating, or otherwise installing the novel anchor assemblies. Preferably, however, the novel anchors are used with the tools disclosed herein. Those tools are capable of installing the novel anchors easily and reliably. Moreover, as now will be discussed in further detail, they incorporate various novel features and represent other embodiments of the subject invention.

Running tool 12 and setting tool 13, as will be appreciated by comparing FIGS. 2-7, share a common tool mandrel 30. Tool mandrel 30 provides a base structure to which the various components of liner hanger 11, running tool 12, and setting tool 13 are connected, directly or indirectly.

Tool mandrel 30 is connected at its upper end to a work string 5 (see FIG. 1A). Thus, it provides a conduit for the passage of fluids from the work string 5 that are used, among other purposes, to balance hydrostatic pressure in the well, to hydraulically actuate setting tool 13 and, ultimately, swage 21, and to inject cement into liner 2. Mandrel 30 also provides for transmission of axial and rotational forces from work string 5 as are necessary to run in hanger 11 and liner 2, drill a borehole during run-in, set hanger 11, and release and retrieve running tool 12 and setting tool 13, all as described in further detail below.

Tool mandrel 30 is a generally cylindrical body. Preferably, as illustrated, it comprises a plurality of tubular sections 31 to facilitate assembly of installation tool 3 and liner hanger 11 as a whole. Tubular sections 31 may be joined by conventional threaded connectors. Preferably, however, the sections 31 of tool mandrel 30 are connected by novel clutch mechanisms of the subject invention.

The novel clutch mechanisms comprise shaft sections having threads on the ends to be joined. The shaft sections have prismatic outer surfaces adjacent to their threaded ends. A threaded connector joins the threaded ends of the shaft sections. The connector has axial splines. A pair of clutch collars is slidably supported on the prismatic outer surfaces of the shaft sections. The clutch collars have prismatic inner surfaces that engage the prismatic outer surfaces of the shaft sections and axial splines that engage the axial splines on the threaded connector. Preferably, the novel clutch mechanisms also comprise recesses adjacent to the mating prismatic surfaces that allow limited rotation of the clutch collars on the prismatic shaft sections to facilitate engagement and disengagement of the mating prismatic surfaces.

Figure 8A:
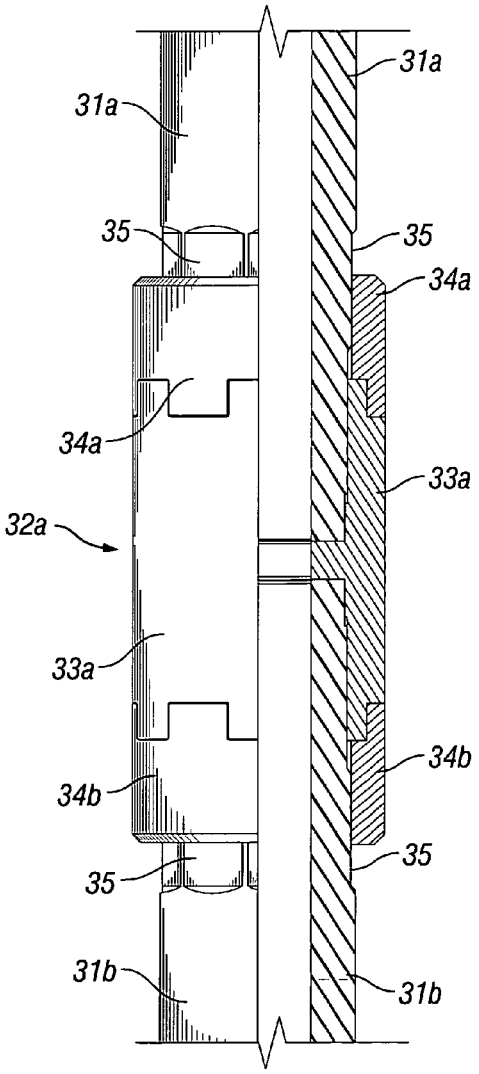
FIG. 8A is a partial, quarter-sectional view of a tool mandrel 30 of installation tool 3 shown in FIG. 1A (that portion located generally in section A of FIG. 1A) showing details of a preferred embodiment 32 of novel clutch mechanisms of the subject—invention.

Accordingly, mandrel 30 of installation tool 3 includes a preferred embodiment 32 of the novel clutch mechanisms. More particularly, mandrel 30 is made up of a number of tubular sections 31 joined by novel connector assemblies 32. Connector assemblies 32 include threaded connectors 33 and clutch collars 34. FIGS. 8-9 show the portion of mandrel 30 and connector assembly 32*a* which is seen in FIG. 2 and which is representative of the connections used to make up mandrel 30. As may be seen in those figures, lower end of tubular section 31*a* and upper end of tubular section 31*b* are threaded into and joined by threaded connector 33*a*. The threads, as is common in the industry, are right-handed threads, meaning that the connection is tightened by rotating the tubular section to the right, i.e., in a clockwise rotation. The novel clutch mechanisms, however, may be also be used in left-handed connections. Clutch collars 34*a* and 34*b* are slidably supported on tubular sections 31*a* and 31*b*, and when in their coupled or "made-up" position as shown in FIG. 8A, abut connector 33*a*. Connector 33*a* and collars 34*a* and 34*b* have mating splines which provide rotational engagement therebetween.

Figure 9A:
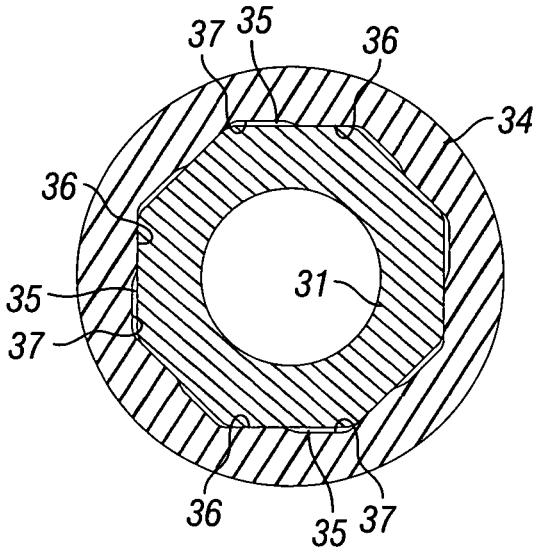
FIG. 9A is a cross-sectional view taken along line 9A-9A of FIG. 8A of connector assembly 32.

Tubular sections 31 have prismatic outer surfaces 35 adjacent to their threaded ends. That is, the normally cylindrical outer surfaces of tubular sections 31 have been cut to provide a plurality of flat surfaces extending axially along the tubular section such that, when viewed in cross section, flat surfaces define or can be extended to define a polygon. For example, as seen best in FIG. 9A, tubular section 31*a* has octagonal prismatic outer surfaces 35. The inner surface of clutch collar 34*a* has mating octagonal prismatic inner surfaces 36. Clutch collar 34*b* is of similar construction. Thus, when in their coupled positions as shown in FIG. 9A, prismatic surfaces 35 and 36 provide rotational engagement between sections 31*a* and 31*b* and collars 34*a* and 34*b*. It will be appreciated, therefore, that torque may be transmitted from one tubular section 31 to another tubular section 31, via collars 34 and connectors 33, without applying torque to the threaded connections between the tubular sections 31.

Figure 8B:
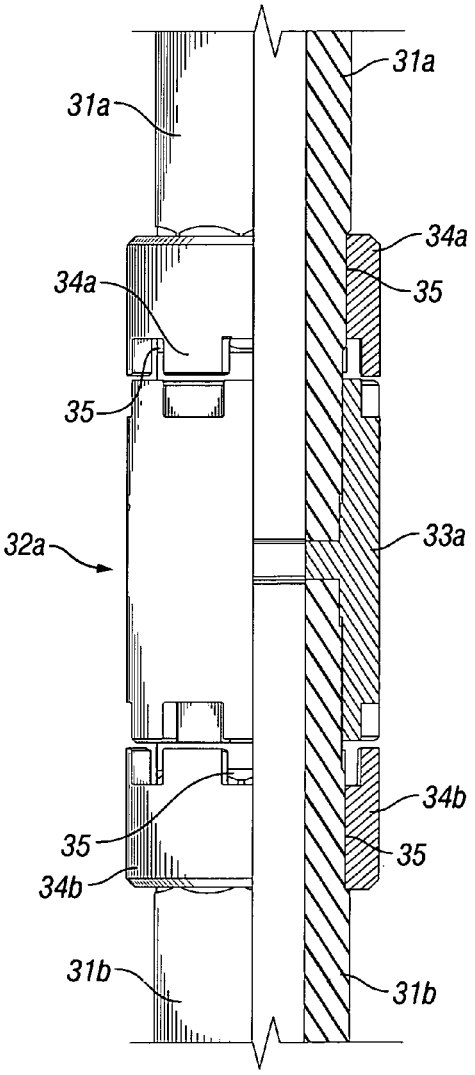
FIG. 8B is a view similar to FIG. 7A showing connector assembly 32 in an uncoupled position.
Figure 9B:
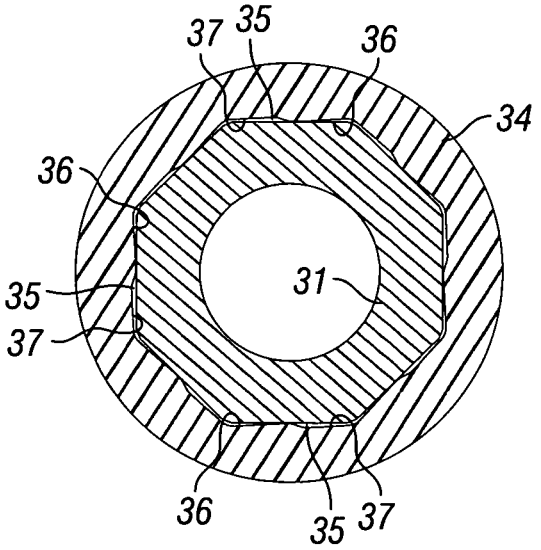
FIG. 9B is a view similar to FIG. 8A taken along line 9B-9B of FIG. 8B showing connector assembly 32 in an uncoupled position.

FIGS. 8B and 9B show connector assembly 32*a* in uncoupled states. It will be noted that prismatic surfaces 35 extend axially on tubular sections 31*a* and 31*b* and allow the splines on collars 34*a* and 34*b* to slide into and out of engagement with the splines on connector 33*a*, as may be appreciated by comparing FIGS. 8A and 8B. Recesses preferably are provided adjacent to the mating prismatic surfaces to facilitate that sliding. For example, as may be seen in FIG. 9, recesses 37 are provided adjacent to prismatic surfaces 36 on collar 34*a*. Those recesses allow collar 34*a* to rotate to a limited degree on tubular sections 31*a*. When rotated to the left, as shown in FIG. 9B, surfaces 35 and 36 are disengaged, and collar 34*a* may slide more freely on tubular section 31*a*. Thus, collars 34 may be more easily engaged and disengaged with connectors 33. Once collars 34 have been moved into engagement with connectors 33, collars 34 and connectors 33 may be rotated together in a clockwise direction to complete make-up of the connection. Preferably, set screws, pins, keys, or the like (not shown) then are installed to secure collars 34 and prevent them from moving axially along tubular sections 31.

It will be appreciated, therefore, that the novel clutch mechanisms provide for reliable and effective transmission of torque in both directions through a sectioned conduit, such as tool mandrel 30. In comparison to conventional set screws and the like, mating prismatic surfaces and splines on the connector and collars provide much greater surface area through which right-handed torque is transmitted. Thus, much greater rotational forces, and forces well in excess of the torque limit of the threaded connection, may be transmitted in a clockwise direction through a sectioned conduit and its connector assemblies without risking damage to threaded connections. The novel clutch mechanisms, therefore, are particularly suited for tools used in drilling in a liner and other applications that subject the tool to high torque. In addition, because the collars cannot rotate in a counterclockwise direction, or if recesses are provided can rotate in a counterclockwise direction only to a limited degree, left-handed torque may be applied to a tool mandrel without risk of significant loosening or of unthreading the connection. Thus, the tool may be designed to utilize reverse rotation, such as may be required for setting or release of a liner or other well component, without risking disassembly of the tool in a well bore.

At the same time, however, it will be appreciated that mandrel 30 may be made up with conventional connections. Moreover, the novel liner hangers may be used with tools having a conventional mandrel, and thus, the novel clutch mechanisms form no part of that aspect of the subject invention. It also will be appreciated that the novel clutch mechanisms may be used to advantage in making up any tubular strings, in mandrels for other tools, or in other sectioned conduits or shafts, or any other threaded connection where threads must be protected from excessive torque.

Running Assembly

Running tool 12 includes a collet mechanism that releasably engages hanger mandrel 20 and which primarily bears the weight of liner 2 or other well components connected directly or indirectly to hanger mandrel 20. Running tool 12 also includes a releasable torque transfer mechanism for transferring torque to hanger mandrel 20 and a releasable dog mechanism that provides a connection between running tool 12 and tool mandrel 30.

Tubular section 31*g* of mandrel 30 provides a base structure on which the various other components of running tool 12 are assembled. As will be appreciated from the discussion follows, most of those other components are slidably supported, directly or indirectly, on tubular section 31*g*. During assembly of installation tool 3 and liner hanger 11 and to a certain extent in their run-in position, however, they are fixed axially in place on tubular section 31*g* by the dog mechanism, which can be released to allow release of the collet mechanism engaging hanger mandrel 20.

More particularly, as seen best in FIG. 7, running tool 12 includes a collet 40 which has an annular base slidably supported on mandrel 30. A plurality of fingers extends axially downward from the base of collet 40. The collet fingers have enlarged ends 41 which extend radially outward and, when running tool 12 is in its run-in position as shown in FIG. 7A, engage corresponding annular recesses 29 in hanger mandrel 20. A bottom collar 42 is threaded onto the end of tool mandrel 30, and its upper beveled end provides radial and axial support for the ends 41 of collet 40. Thus, collet 40 is able to bear the weight of mandrel 20, liner 2, and any other well components that may be connected directly or indirectly thereto. Bottom collar 42 also provides a connection, e.g., via a threaded lower end, to a slick joint 15 or other well components that may be included below hanger 11 in liner assembly 1 as desired.

As may be seen best in FIGS. 6-7, collet 40, or more precisely, its annular base is slidably supported on mandrel 30 within an assembly including a sleeve 43, an annular collet cap 46, an annular sleeve cap 44, and annular thrust cap 45. Sleeve 43 is generally disposed within hanger mandrel 20 and slidably engages the inner surface thereof. Sleeve cap 44 is threaded to the lower end of sleeve 43 and is slidably carried between hanger mandrel 20 and collet 40. Thrust cap 45 is threaded to the upper end of sleeve 43 and is slidably carried between swage 21 and tubular section 31*g*. Collet cap 46 is threaded to the upper end of collet 40 and is slidably carried between sleeve 43 and tubular section 31*g*. The collet 40 and cap 46 subassembly is spring loaded within sleeve 43 between sleeve cap 44 and thrust cap 45.

As may be appreciated from FIG. 6, thrust cap 45 abuts at its upper end an annular dog housing 47 and abuts hanger mandrel 20 at its lower end. Hanger mandrel 20 and thrust cap 45 rotationally engage each other via mating splines, similar to those described above in reference to the connector assemblies 32 joining tubular sections 31. In addition, though not shown in any detail, tubular section 31*g* is provided with lugs, radially spaced on its outer surface, which rotationally engage corresponding slots in thrust cap 45. The slots extend laterally and circumferentially away from the lugs to allow, for reasons discussed below, tubular section 31*g* to move axially downward and to rotate counterclockwise a quarter-turn. Otherwise, however, when running tool 12 is in its run-in position the engagement between those lugs and slots provide rotational engagement in a clockwise direction between tubular section 31*g* and thrust cap 45, thus ultimately allowing clockwise torque to be transmitted from tool mandrel 30 to hanger mandrel 20. Running tool 12, therefore, may be used to drill in a liner. That is, a drill bit may be attached to the end liner 2 and the well bore extended by rotating work string 5.

Figure 6A:
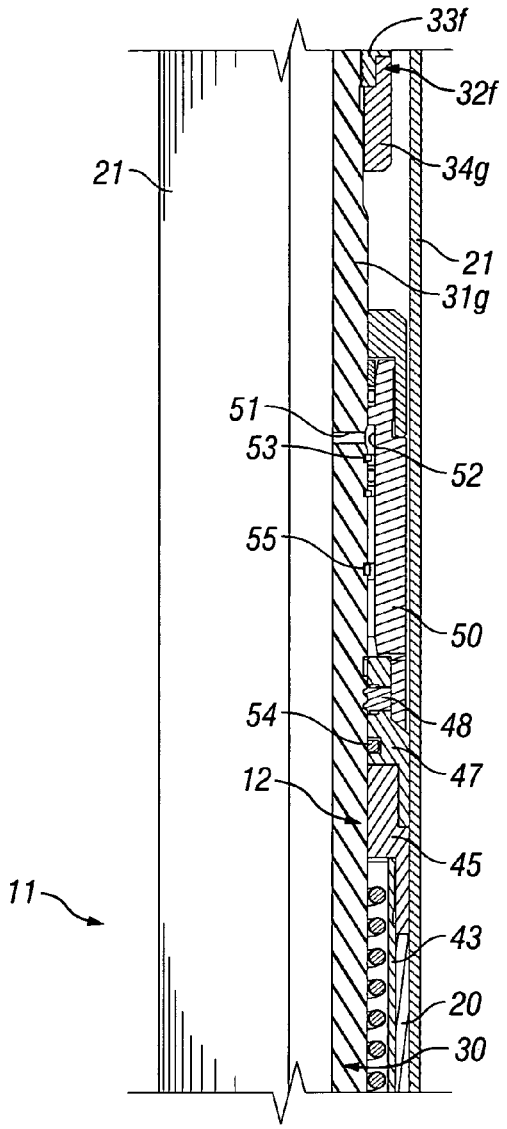
FIG. 6A is an enlarged quarter-sectional view generally corresponding to section E of liner assembly 1 shown in FIG. 1A showing details of a preferred embodiment of the running assemblies of the subject invention showing running tool 12 and liner hanger 11 in their run-in position.

Although not shown in their entirety or in great detail, it will be appreciated that dog housing 47 and tubular section 31*g* of mandrel 30 have cooperating recesses that entrap a plurality of dogs 48 as is common in the art. Those recesses allow dogs 48 to move radially, that is, in and out to a limited degree. It will be appreciated that the inner ends (in this sense, the bottom) of dogs 48 are provided with pawls which engage the recess in tubular section 31*g*. The annular surfaces of those pawls and recesses are coordinated such that downward movement of mandrel 30 relative to dog housing 47, for reasons to be discussed below, urges dogs 48 outward. In the run-in position, as shown in FIG. 6A, however, a locking piston 50, which is slidably supported on tubular section 31*g*, overlies dog housing 47 and the tops of the cavities in which dogs 48 are carried.

Thus, outward radial movement of dogs 48 is further limited and dogs 48 are held in an inward position in which they engage both dog housing 47 and tubular section 31*g*. Thus, dogs 48 are able to provide a translational engagement between mandrel 30 and running tool 12 when it is in the run-in position. This engagement is not typically loaded with large amounts of force when the tool is in its run-in position, as the weight of installation tool 3 and liner 2 is transmitted to tool mandrel 30 primarily through collet ends 41 and bottom collar 41 and torque is transmitted from mandrel 30 through thrust cap 45 and hanger mandrel 20. The engagement provided by dogs 48, however, facilitates assembly of installation tool 3 and hanger 11 and will bear any compressive load inadvertently applied between hanger 11 and tool mandrel 30. Thus, dogs 48 will prevent liner hanger 11 and running tool 12 from moving upward on mandrel 30 such as might otherwise occur if liner assembly 1 gets hung up as it is run into an existing casing. Release of dogs 48 from that engagement will be described in further detail below in the context of setting hanger 11 and release of running tool 12.

It will be appreciated that running tool 12 described above provides a reliable, effective mechanism for releasably engaging liner hanger 11, for securing liner hanger from moving axially on mandrel 30, and for transmitting torque from mandrel 30 to hanger mandrel 20. Thus, it is a preferred tool for use with the liner hangers of the subject invention. At the same time, however, other conventional running mechanisms, such as mechanisms utilizing a left-handed threaded nut or dogs only, may be used, particularly if it is not necessary or desirable to provide for the transmission of torque through the running mechanism. The subject invention is in no way limited to a specific running tool.

Setting Assembly

Setting tool 13 includes a hydraulic mechanism for generating translational force, relative to the tool mandrel and the work string to which it is connected, and a mechanism for transmitting that force to swage 21 which, upon actuation, expands metal sleeve 22 and sets hanger 11. It is connected to running tool 12 through their common tool mandrel 30, with tubular sections 31*a-f* of mandrel 30 providing a base structure on which the various other components of setting tool 13 are assembled.

As will be appreciated from FIGS. 2-5, the hydraulic mechanism comprises a number of cooperating hydraulic actuators 60 supported on tool mandrel 30. Those hydraulic actuators are linear hydraulic motors designed to provide linear force to swage 21. Those skilled in the art will appreciate that actuators 60 are interconnected so as to "stack" the power of each actuator 60 and that their number and size may be varied to create the desired linear force for expanding sleeve 22.

As is common in such actuators, they comprise a mandrel. Though actuators for other applications may employ different configurations, the mandrel in the novel actuators, as is typical for oil well tools and components, preferably is a generally cylindrical mandrel. A hydraulic cylinder is slidably coupled to the mandrel. The hydraulic cylinder has a bottom hydraulic chamber with an inlet port and a top hydraulic chamber with an outlet port. Typically, but not necessarily, conventional hydraulic cylinders will include a stationary sealing member, such as a piston, seal, or an extension of the mandrel itself, which extends continuously around the exterior of the mandrel. A hydraulic barrel or cylinder is slidably supported on the outer surfaces of the mandrel and the stationary sealing member. The cylinder includes a sleeve or other body member with a pair of dynamic sealing members, such as pistons, seals, or extensions of the body member itself, spaced on either side of the stationary sealing member and slidably supporting the cylinder. The stationary sealing member divides the interior of the cylinder into two hydraulic chambers, a top chamber and a bottom chamber. An inlet port provides fluid communication into the bottom hydraulic chamber. An outlet port provides fluid communication into the top hydraulic chamber. Thus, when fluid is introduced into the bottom chamber, relative linear movement is created between the mandrel and the cylinder. In setting tool 13, this is downward movement of the cylinder relative to mandrel 30.

For example, what may be viewed as the lowermost hydraulic actuator 60*e* is shown in FIG. 4. This lowermost hydraulic actuator 60*e* comprises floating annular pistons 61*e* and 61*f*. Floating pistons 61*e* and 61*f* are slidably supported on tool mandrel 30, or more precisely, on tubular sections 31*e* and 31*f*, respectively. A cylindrical sleeve 62*e* is connected, for example, by threaded connections to floating pistons 61*e* and 61*f* and extends therebetween. An annular stationary piston 63*e* is connected to tubular section 31*f* of tool mandrel 30, for example, by a threaded connection. Preferably, set screws, pins, keys, or the like are provided to secure those threaded connections and to reduce the likelihood they will loosen.

Figure 4A:
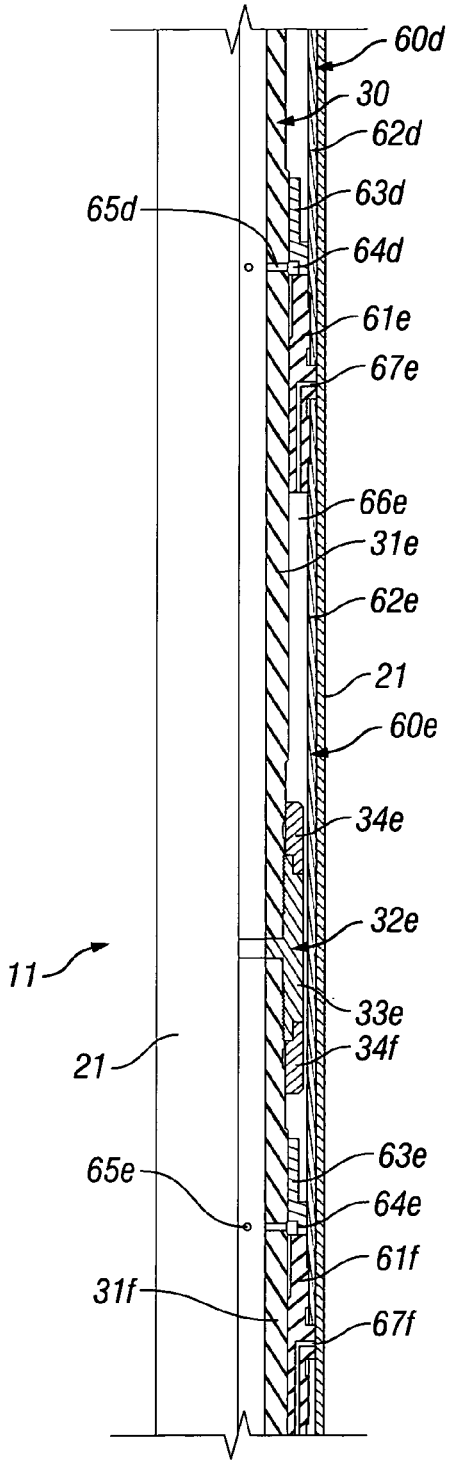
FIG. 4A is an enlarged quarter-sectional view generally corresponding to section C of liner assembly 1 shown in FIG. 1A showing further details of setting tool 13 and portions of liner hanger 11 in their run-in position.
Figure 4B:
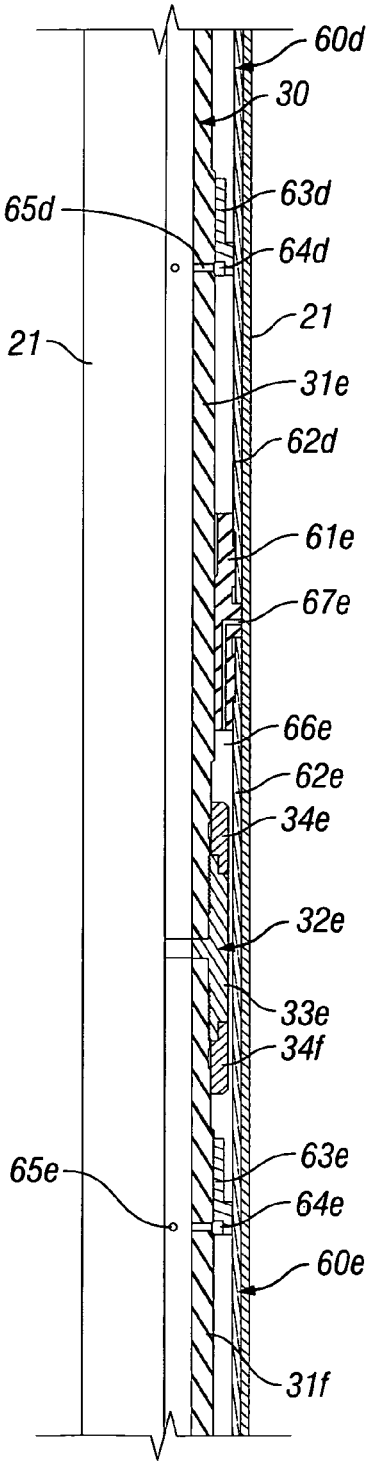
FIG. 4B is a view similar to FIG. 4A showing setting tool 13 and liner hanger 11 in their set position.

In the run-in position shown in FIG. 4A, floating piston 61*f* is in close proximity to stationary piston 63*e*. A bottom hydraulic chamber is defined therebetween, either by spacing the pistons or by providing recesses in one or both of them, and a port is provided through the mandrel to allow fluid communication with the bottom hydraulic chamber. For example, floating piston 61*f* and stationary piston 63*e* are provided with recesses which define a bottom hydraulic chamber 64*e* therebetween, even if pistons 61*f* and 63*e* abut each other. One or more inlet ports 65*e* are provided in tubular section 31*f* to provide fluid communication between the interior of tool mandrel 30 and bottom hydraulic chamber 64*e*.

Floating piston 61*e*, on the other hand, is distant from stationary piston 63*e*, and a top hydraulic chamber 66*e* is defined therebetween. One or more outlet ports 67*e* are provided in floating piston 61*e* to provide fluid communication between top hydraulic chamber 66*e* and the exterior of cylinder sleeve 62*e*. Alternately, outlet ports could be provided in cylinder sleeve 62*e*, and it will be appreciated that the exterior of cylinder sleeve 62*e* is in fluid communication with the exterior of the tool, i.e., the well bore, via clearances between cylinder sleeve 62*e* and swage 21. Thus, fluid flowing through inlet ports 65*e* into bottom hydraulic chamber 64*e* will urge floating piston 61*f* downward, and in turn cause fluid to flow out of top hydraulic chamber 66*e* through outlet ports 67*e* and allow actuator 60*e* to travel downward along mandrel 30, as may be seen in FIG. 4B.

Setting tool 13 includes another actuator 60*d* of similar construction located above actuator 60*e* just described. Parts of actuator 60*d* are shown in FIGS. 3 and 4.

Setting tool 13 engages swage 21 of liner hanger 11 via another hydraulic actuator 60*c* which is located above hydraulic actuator 60*d*. More particularly, as may be seen in FIG. 3, engagement actuator 60*c* comprises a pair of floating pistons 61*c* and 61*d* connected by a sleeve 62*c*. Floating pistons 61*c* and 61*d* are slidably supported, respectively, on tubular sections 31*c* and 31*d* around stationary piston 63*c*. One or more inlet ports 65*c* are provided in tubular section 31*c* to provide fluid communication between the interior of tool mandrel 30 and bottom hydraulic chamber 64*c*. One or more outlet ports 67*c* are provided in cylinder sleeve 62*c* to provide fluid communication between top hydraulic chamber 66*c* and the exterior of actuator 60*c*.

It will be noted that the upper portion of sleeve 62*c* extends above swage 21 while its lower portion extends through swage 21, and that upper end of sleeve 62*c* is enlarged relative to its lower portion. An annular adjusting collar 68 is connected to the reduced diameter portion of sleeve 62*c* via, e.g., threaded connections. An annular stop collar 69 is slidably carried on the reduced diameter portion of sleeve 62*c* spaced somewhat below adjusting collar 68 and just above and abutting swage 21. Adjusting collar 68 and stop collar 69 are tied together by shear pins (not shown) or other shearable members. It will be appreciated that during assembly of installation tool 3, rotation of adjusting collar 68 and stop collar 69 allows relative movement between setting tool 13 and running tool 12 on the one hand and liner hanger 11 on the other, ultimately allowing collet ends 41 of running tool 12 to be aligned in annular recesses 29 of hanger mandrel 20.

Setting tool 13 includes what may be viewed as additional drive actuators 60*a* and 60*b* located above engagement actuator 60*c* shown in FIG. 3. As with the other hydraulic actuators 60, and as may be seen in FIG. 2, the uppermost hydraulic actuator 60*a* comprises a pair of floating pistons 61*a* and 61*b* connected by a sleeve 62*a* and slidably supported, respectively, on tubular sections 31*a* and 31*b* around stationary piston 63*a*. One or more inlet ports 65*a* are provided in tubular section 31*a* to provide fluid communication between the interior of tool mandrel 30 and bottom hydraulic chamber 64*a*. One or more outlet ports 67*a* are provided in floating piston 61*a* to provide fluid communication between top hydraulic chamber 66*a* and the exterior of actuator 60*a*. (It will be understood that actuator 60*b*, as shown in part in FIGS. 2 and 3, is constructed in a fashion similar to actuator 60*a*.)

It will be appreciated that hydraulic actuators 60 preferably are immobilized in their run-in position. Otherwise, they may be actuated to a greater or lesser degree by differences in hydrostatic pressure between the interior of mandrel 30 and the exterior of installation tool 3. Thus, setting tool 13 preferably incorporates shearable members, such as pins, screws, and the like, or other means of releasably fixing actuators 60 to mandrel 30.

Setting tool 13 preferably incorporates the hydraulic actuators of the subject invention. The novel hydraulic actuators include a balance piston. The balance piston is slidably supported within the top hydraulic chamber of the actuator, preferably on the mandrel. The balance piston includes a passageway extending axially through the balance piston. Fluid communication through the piston and between its upper and lower sides is controlled by a normally shut valve in the passageway. Thus, in the absence of relative movement between the mandrel and the cylinder, the balance piston is able to slide in response to a difference in hydrostatic pressure between the outlet port, which is on one side of the balance piston, and the portion of the top hydraulic chamber that is on the bottom side of the balance piston.

Figure 2A:
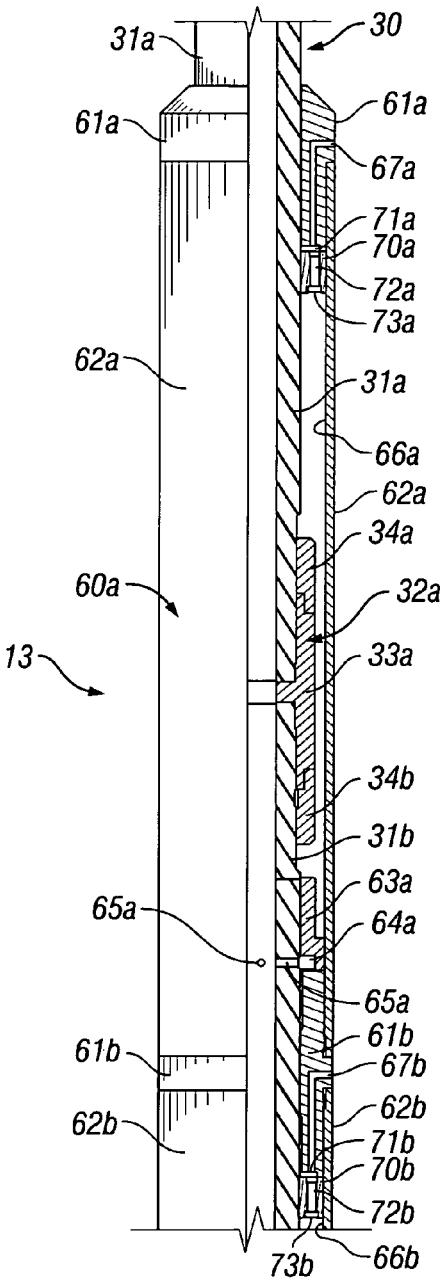
FIG. 2A is an enlarged quarter-sectional view generally corresponding to section A of liner assembly 1 shown in FIG. 1A showing details of a preferred embodiment 13 of the setting assemblies of the subject inventions showing setting tool 13 in its run-in position.
Figure 2B:
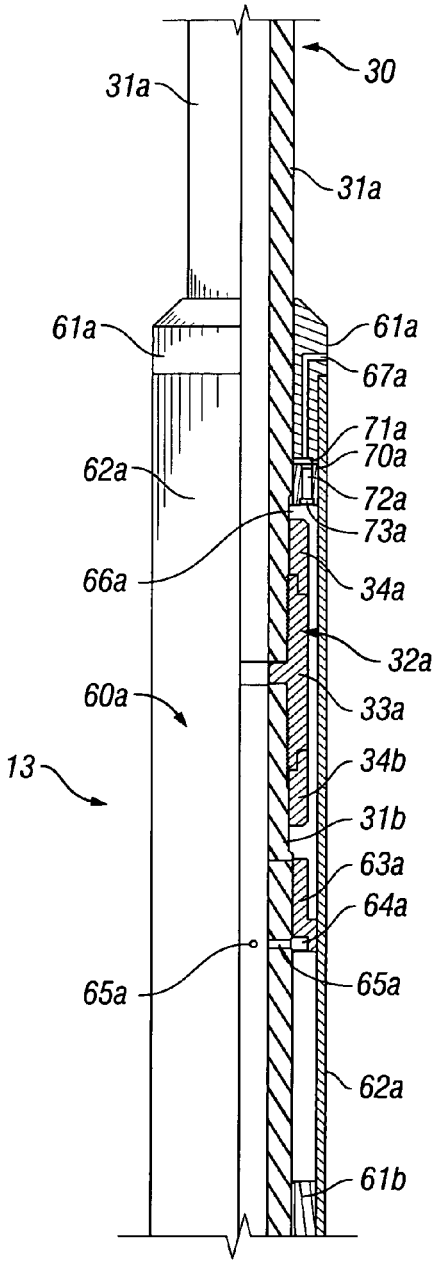
FIG. 2B is a quarter-sectional view similar to FIG. 2A showing setting tool 13 in its set position.

For example, as may be seen in FIG. 2, actuator 60*a* includes balance piston 70*a*. Balance piston 70*a* is slidably supported on tubular section 31*a* of mandrel 30 in top hydraulic chamber 66*a* between floating piston 61*a* and stationary piston 63*a*. When setting tool 13 is in its run-in position, as shown in FIG. 2A, balance piston 70*a* is located in close proximity to floating piston 61*a*. A hydraulic chamber is defined therebetween, either by spacing the pistons or by providing recesses in one or both of them, and a port is provided through the mandrel to allow fluid communication with the hydraulic chamber. For example, floating piston 61*a* is provided with a recess which defines a hydraulic chamber 71*a* therebetween, even if pistons 61*a* and 70*a* abut each other.

Balance piston 70*a* has a passageway 72*a* extending axially through its body portion, i.e., from its upper side to its lower side. Passageway 72*a* is thus capable of providing fluid communication through balance piston 70*a*, that is, between hydraulic chamber 71*a* and the rest of top hydraulic chamber 66*a*. Fluid communication through passageway 72*a*, however, is controlled by a normally shut valve, such as rupturable diaphragm 73*a*. When diaphragm 73*a* is in its closed, or unruptured state, fluid is unable to flow between hydraulic chamber 71*a* and the rest of top hydraulic chamber 66*a*.

Actuator 60*b* also includes a balance piston 70*b* identical to balance piston 70*a* described above. Thus, when setting tool 13 is in its run-in position shown in FIG. 2A, balance pistons 70*a* and 70*b* are able to equalize pressure between the top hydraulic chambers 66*a* and 66*b* and the exterior of actuators 60*a* and 60*b* such as might develop, for example, when liner assembly 1 is being run into a well. Fluid is able to enter outlet ports 67*a* and 67*b* and, to the extent that such exterior hydrostatic pressure exceeds the hydrostatic pressure in top hydraulic chambers 66*a* and 66*b*, balance pistons 70*a* and 70*b* will be urged downward until the pressures are balanced. Such balancing of internal and external pressures is important because it avoids deformation of cylinder sleeves 62*a* and 62*b* that could interfere with travel of sleeves 62*a* and 62*b* over stationary pistons 63*a* and 63*b*.

Moreover, by not allowing ingress of significant quantities of fluid from a well bore as liner assembly 1 is being run into a well, balance pistons 70*a* and 70*b* further enhance the reliability of actuators 60*a* and 60*b*. That is, balance pistons 70*a* and 70*b* greatly reduce the amount of debris that can enter top hydraulic chambers 66*a* and 66*b*, and since they are located in close proximity to outlet ports 67*a* and 67*b*, the substantial majority of the travel path is maintained free and clear of debris. Hydraulic chambers 66*a* and 66*b* preferably are filled with clean hydraulic fluid during assembly of setting tool 13, thus further assuring that when actuated, floating pistons 61*a* and 61*b* and sleeves 62*a* and 62*b* will slide cleanly and smoothly over, respectively, tubular sections 31*a* and 31*b* and stationary pistons 63*a* and 63*b*.

It will be appreciated that for purposes of balancing the hydrostatic pressure between the top hydraulic chamber and a well bore the exact location of the balance piston in the top hydraulic chamber of the novel actuators is not critical. It may be spaced relatively close to a stationary piston and still provide such balancing. In practice, the balance piston will not have to travel a great distance to balance pressures and, therefore, it may be situated initially at almost any location in the top hydraulic chamber between the external opening of the outlet port and the stationary piston.

Preferably, however, the balance piston in the novel actuators is mounted as close to the external opening of the outlet port as practical so as to minimize exposure of the inside of the actuator to debris from a well bore. It may be mounted within a passageway in what might be termed the "port," such as ports 67*a* shown in the illustrated embodiment 60*a*, or within what might otherwise be termed the "chamber,' such as top hydraulic chamber 66*a* shown in the illustrated embodiment 60*a*. As understood in the subject invention, therefore, when referencing the location of a balance piston, the top hydraulic chamber may be understood as including all fluid cavities, chambers, passageways and the like between the port exit and the stationary piston. If mounted in a relatively narrow passageway, such as the outlet ports 67*a*, however, the balance piston will have to travel greater distances to balance hydrostatic pressures. Thus, in the illustrated embodiment 60*a* the balance piston 70*a* is mounted on tubular sections 31*a* in the relatively larger top hydraulic chamber 66*a*.

It also will be appreciated that, to provide the most effective protection from debris, the normally shut valves in the balance position should be selected such that they preferably are not opened to any significant degree by the pressure differentials they are expected to encounter prior to actuation of the actuator. At the same time, as will be appreciated from the discussion that follows, they must open, that is, provide release of increasing hydrostatic pressure in the top hydraulic chamber when the actuator is actuated. Most preferably, the normally shut valves remain open once initially opened. Thus, rupturable diaphragms are preferably employed because they provide reliable, predictable release of pressure, yet are simple in construction and can be installed easily.

Other normally shut valve devices, such as check valves, pressure relief valves, and plugs with shearable threads, however, may be used in the balance piston on the novel actuators.

As will be appreciated by workers in the art, the actuator includes stationary and dynamic seals as are common in the art to seal the clearances between the components of the actuator and to provide efficient operation of the actuator as described herein. In particular, the clearances separating the balance piston from the mandrel and from the sleeve, that is, the top hydraulic chamber, preferably are provided with dynamic seals to prevent unintended leakage of fluid around the balance piston. The seals may be mounted on the balance piston or on the chamber as desired. For example, balance pistons 70*a* and 70*b* may be provided with annular dynamic seals (not shown), such as elastomeric O-rings mounted in grooves, on their inner surface abutting tubular sections 31*a* and 31*b* and on their outer surfaces abutting sleeves 62*a* and 62*b*, respectively. Alternatively, one or both of the seals may be mounted on the top hydraulic chambers 66*a* and 66*b*, for example, in grooves on tubular sections 31*a* and 31*b* or sleeves 62*a* and 62*b*.

As noted above, prior to actuation, the balance pistons essentially seal the top hydraulic chambers and prevent the incursion of debris. Under certain conditions, however, such as increasing downhole temperatures, pressure within the top hydraulic chambers can increase beyond the hydrostatic pressure in the well bore. The balance pistons will be urged upward until pressure in the top hydraulic chambers is equal to the hydraulic pressure in the well bore. In the event that a balance piston "bottoms" out against the outlet port, however, pressure within the top hydraulic chamber could continue to build, possibly to the point where a diaphragm would be ruptured, thereby allowing debris laden fluid from the well bore to enter the chamber. Thus, the novel actuators preferably incorporate a pressure release device allowing release of potentially problematic pressure from the top hydraulic chamber as might otherwise occur if the balance pistons bottom out.

For example, instead of using rupturable diaphragms 73*a* and 73*b*, check valves or pressure relief valves may be mounted in passageways 72*a* and 72*b*. Such valves, if used, should also allow a desired level of fluid flow through passageways 72*a* and 72*b* during actuation. Alternately, an elastomeric burp seal (not shown) may be mounted in one or both of the clearances separating the balance pistons 70*a* and 70*b* from, respectively, tubular sections 31*a* and 31*b* and sleeves 62*a* and 62*b*. Such burp seals would then allow controlled release of fluid from top hydraulic chambers 66*a* and 66*b* to, respectively, hydraulic chambers 71*a* and 71*b* if balance pistons 70*a* and 70*b* were to bottom out against, respectively, floating pistons 61*a* and 61*b*. Such burp valves would, of course, be designed with a release pressure sufficiently below the pressure required to open the rupturable diaphragm or other normally shut valve.

Preferably, however, the pressure relief device is provided in the cylindrical mandrel. For example, a check or pressure release valve (not shown) may be mounted in tubular sections 31*a* and 31*b* so as to allow controlled release of fluid from top hydraulic chambers 66*a* and 66*b* to the interior of mandrel 30. Such an arrangement has an advantage over a burp seal as described above in that it would be necessary to overcome flow through a burp seal in order to build up sufficient pressure to rupture a diaphragm or otherwise to open a normally shut valve device. If a pressure relief device is provided in the cylindrical mandrel, pressure in the top hydraulic chamber will be equal to pressure within the interior of the mandrel, and there will be no flow through the pressure release device that must be overcome.

Figure 5A:
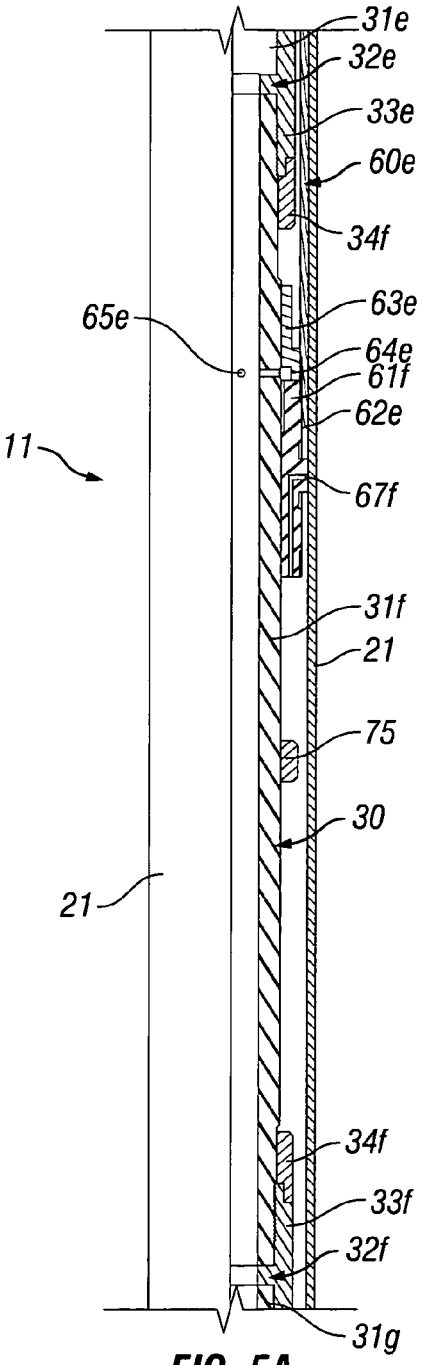
FIG. 5A is an enlarged quarter-sectional view generally corresponding to section D of liner assembly 1 shown in FIG. 1A showing additional details of setting tool 13 and portions of liner hanger 11 in their run-in position.
Figure 5B:
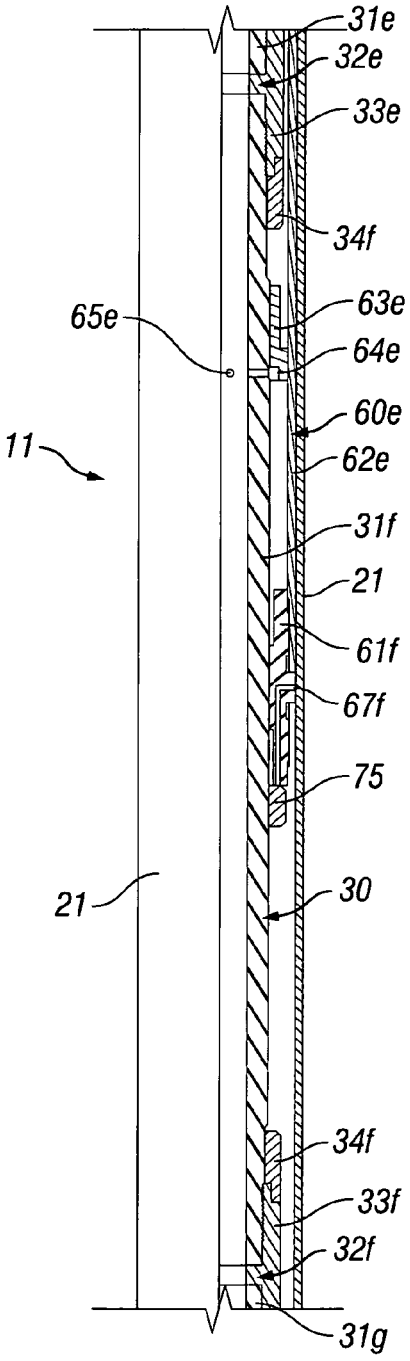
FIG. 5B is a view similar to FIG. 5A showing setting tool 13 and liner hanger 11 in their set position.

The setting assemblies of the subject invention also preferably include some means for indicating whether the swage has been fully stroked into position under the expandable metal sleeve. Thus, as shown in FIG. 5, setting tool 13 includes a slidable, indicator ring 75 supported on tubular section 31*f* just below actuator 60*e* described above. When setting tool 13 is in its run-in position, indicator ring 75 is fixed to tubular section 31*f* via a shear member, such as a screw or pin (not shown). It is positioned on section 31*f* relative to floating piston 61*f*, however, such that when floating piston 61*f* has reached the full extent of its travel, it will impact indicator ring 75 and shear the member fixing it to section 31*f*. Thus, indicator ring 75 will be able to slide freely on mandrel 30 and, when the tool is retrieved from the well, it may be readily confirmed that setting tool 13 fully stroked and set metal sleeve 22.

It will be appreciated that setting tool 13 described above provides a reliable, effective-mechanism for actuating swage 21, and it incorporates novel hydraulic actuators providing significant advantages over the prior art. Thus, it is a preferred tool for use with the anchor assemblies of the subject invention. At the same time, however, there are a variety of hydraulic and other types of mechanisms which are commonly used in downhole tools to generate linear force and motion, such as hydraulic jack mechanisms and mechanisms actuated by explosive charges or by releasing weight on, pushing, pulling, or rotating the work string. In general, such mechanism may be adapted for use with the novel anchor assemblies, and it is not necessary to use any particular setting tool or mechanism to set the novel anchor assemblies.

Moreover, it will be appreciated that the novel setting assemblies, because they include hydraulic actuators having a balance piston, are able to balance hydraulic pressures that otherwise might damage the actuator and are able to keep the actuator clear of debris that could interfere with its operation. Such improvements are desirable not only in setting the anchor assemblies of the subject invention, but also in the operation of other downhole tools and components where hydraulic actuators or other means of generating linear force are required. Accordingly, the subject invention in this aspect is not limited to use of the novel setting assemblies to actuate a particular anchor assembly or any other downhole tool or component. They may be used to advantage in the setting assemblies of many other downhole tools, such as expandables, expandable liner hangers, liner hangers, whipstocks, packers, bridge plugs, cement plugs, frac plugs, slotted pipe, and polished bore receptacles (PBRs).

Flow Diverter Assembly

As noted above, liners typically will be cemented in a well and, therefore, the novel liner assemblies preferably incorporate tools to perform cementing operations, such as the return flow diverters of the subject invention. The novel return flow diverters comprise a cylindrical body adapted for installation in a well as part of a liner. The cylindrical body has a fluid port, typically a plurality of such ports, adapted to allow fluids displaced by a cementing operation to flow from an annulus between the liner and the well into the tool.

A cover is supported on the cylindrical body for movement from an open position, in which the port is open, to a closed position, in which the port is closed by the cover. A transmission is disposed within the cylindrical body. The transmission defines a cylindrical passageway adapted to accommodate a tubular conduit which extends through the cylindrical body, which conduit may be used for injecting cement into the liner below the flow diverter. The transmission is releasably engaged with the cover and operable to move the cover from the open position to the closed position.

For example, preferred liner assembly 1 incorporates preferred return flow diverter 10, cement packoff 14, slick joint 15, and a liner wiper plug (not shown). Flow diverter 10 and cement packoff 14, as shown in FIG. 1, are incorporated into liner assembly 1 below hanger 11. As may be seen in FIG. 7, slick joint 15 is a tubular section connected to running tool 12, more specifically, to bottom collar 42 at the end of tool mandrel 30. It has an outer diameter significantly less than the inner diameter of hanger mandrel 20 and, necessarily, of swage 21. It extends from running tool 12 downward through flow diverter 10, as shown in FIG. 10, and cement packoff 14 (not shown).

Preferred flow diverter 10 comprises a generally cylindrically-shaped housing 80 which, as discussed in further detail below, will ultimately form part of the liner 2 which is installed in the well. Its interior surface generally defines a cylindrical conduit which preferably has a diameter at least as large as liner tubulars 8 with which it will be assembled. An upper portion 81 of housing 80 is provided with an enlarged outer diameter and a gage ring 82 is secured to the lower end of housing 80 to provide gage protection for flow diverter 10. Both ends of housing 80 are threaded so that it may be incorporated into liner assembly 1. Specifically, housing 80 is assembled into liner assembly 1 downhole of liner hanger 11, as may be seen in FIG. 1, and is connected directly, or indirectly via liner tubulars or connectors, to hanger mandrel 20. Cement packoff 14 is incorporated into and connected to liner assembly 1 in a similar fashion below flow diverter 10.

As shown in further detail in FIG. 10, diverter housing 80 comprises a number of ports 83 defined in the walls thereof. Ports 83 are configured and sized to allow fluid to flow between the interior of housing 80 and the annulus between liner assembly 1 and the well into which it is run. In particular, as described below, they are configured and sized to allow fluid displaced from the annulus during cementing operations to flow from the annulus into housing 80.

Figure 10A:
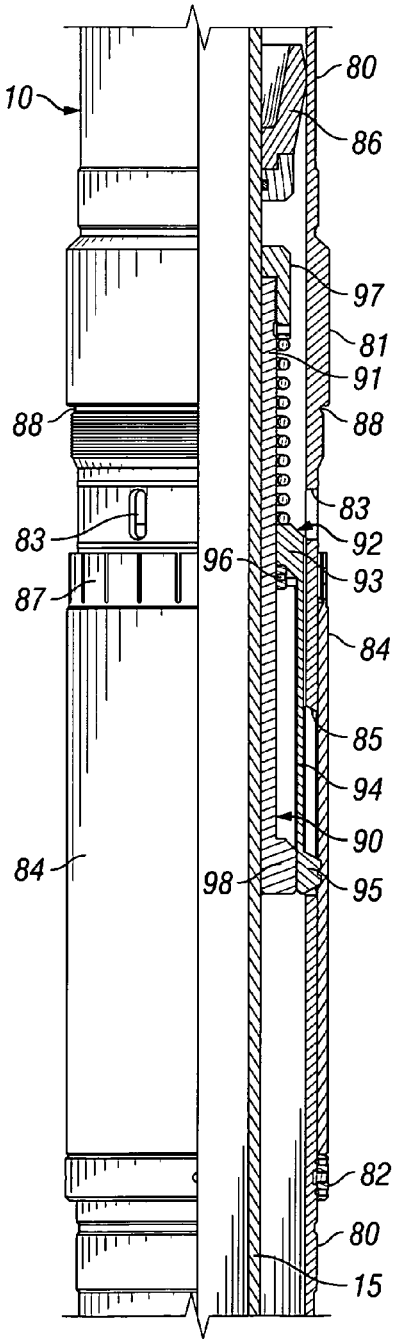
FIG. 10A is an enlarged quarter-sectional view of a preferred embodiment 10 of the return flow diverters of the subject invention which is incorporated into preferred liner assembly 1 shown in FIG. 1A showing ports 83 and other details of flow diverter 10 in its run-in position.
Figure 10B:
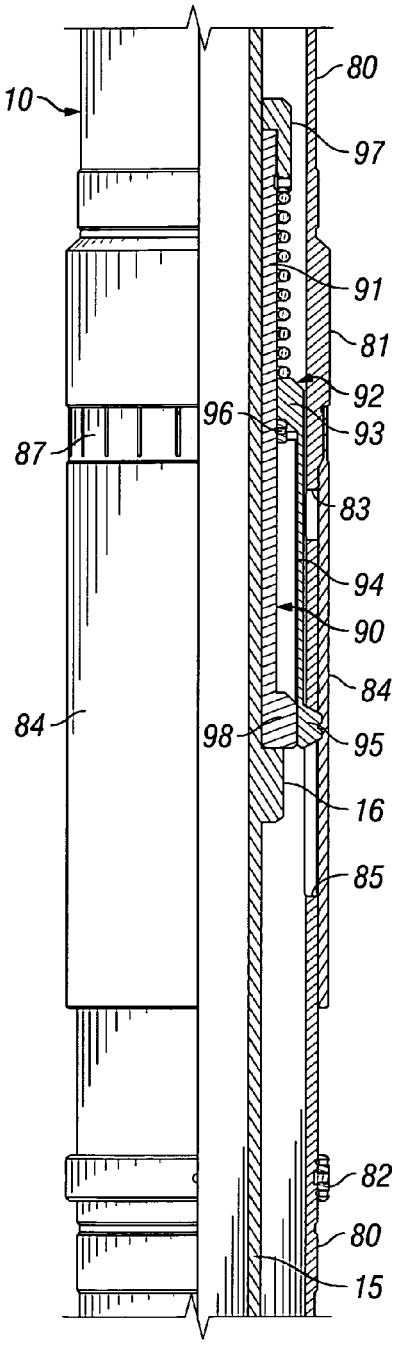
FIG. 10B is a view similar to FIG. 10A showing flow diverter 10 wherein ports 83 have been closed.

A cylindrical sleeve 84 is supported on the outer surface of housing 80. As will be appreciated by comparing FIGS. 10A and 10B, sleeve 84 is supported for axial movement from an open, run-in position, in which ports 83 are uncovered by sleeve 84 as shown in FIG. 10A, to a closed, installed position, in which sleeve 84 covers ports 83 as shown in FIG. 10B. Ports 83, when sleeve 84 is in its open, run-in position, allow fluid displaced from a cementing operation to flow from the annulus to the interior of liner assembly 1, as described in further detail below. When sleeve 84 cover ports 83 it substantially prevents fluid flow from the annulus into flow diverter 10 so that the integrity of liner 2, into which housing 80 is incorporated, will be maintained.

The novel flow diverters, as they are assembled into and run in with a liner assembly, comprise a transmission which is disposed within the cylindrical body and releasably engaged with the cover and operable to move the cover from the open position to the closed position. For example, preferred flow diverter 10 comprises a transmission 90 which is operable to move sleeve 84 from its open position to its closed position. As may be seen in FIG. 10, transmission 90 comprises a carriage 91 and a collet 92. Carriage 91 is a generally cylindrical, sleeve-like body disposed within diverter housing 80. Collet 92, similar to collet 40, has an annular base 93 and a plurality of flexible fingers 94. Annular base 93 of collet 92 is slidably supported on the outer surface of carriage 91, such that collet 92 is disposed between carriage 91 and housing 80. The enlarged ends 95 of collet fingers 94 extend through slots 85 in housing 80 to engage corresponding recesses in sleeve 84. They are prevented from flexing out of engagement with sleeve 84 by an enlarged lower portion 98 of carriage 91. Thus, collet 92 engages sleeve 84 when flow diverter 10 is run into the well.

Annular base 93 of collet 92 in turn is releasably engaged with carriage 91 by, for example, shear wire 96. Alternately, collet 92 may be releasably engaged with carriage 91 via shearable pins, screws and the like. Collet 92 also may be releasably engaged with carriage 91 by dogs, such as radially displaceable dogs shown in FIGS. 14A and 14B and discussed below. In any event, sleeve 84, collet 92, and carriage 91 are engaged together when flow diverter 10 is run into the well. Otherwise, and specifically when shear wire 96 has been sheared during operation of flow diverter 10 as described below, carriage 91 is able to slide axially within annular base 93 of collet 92 as described in further detail below. Carriage 91 also is provided with a threaded cap 97, and a torsion spring is disposed between carriage cap 97 and collet base 93 to facilitate assembly of transmission 90 in diverter housing 80.

Carriage 91 defines a cylindrical passageway through which slick joint 15 extends. Slick joint 15, as noted above, is connected at its upper end to mandrel 30 which is in turn connected to work string 5. It preferably is connected at its lower end to other liner assembly components, such as a ball seat assembly, a plug holder assembly, and a liner wiper plug, which are used in cementing or other tool operations. In any event, slick joint 15 together with those other components provide a conduit through which cement may be introduced into liner 2 below flow diverter 10 and cement packoff 14. As cement is introduced into liner 2, cement packoff 14 prevents cement from flowing up into liner 2 and flow diverter 10 and returns are allowed to flow from the annulus, through ports 83, and into housing 80.

The novel diverters also preferably incorporate a one-way seal, such as one or more lip seals or, as shown in FIG. 10A, a swab cup 86. Swab cup 86 is mounted on slick joint 15 at a point above ports 83 and provides a one-way seal between slick joint 15 and housing 80. It comprises a cup-shaped elastomeric member, as is conventional in the art, which allows fluid to flow through housing 80 in an upward direction past swab cup 86. If fluid pressure is applied above swab cup 86, however, the elastomeric member will expand against and seal with housing 80 and prevent fluid flow in a downward direction. As discussed further below, providing a swab cup or other one-way seal facilitates pressure testing of a seal established between the liner and an existing casing before a cementing operation is undertaken, yet also allows displaced fluid to flow upward through the novel flow diverters as the liner is cemented. It also will be appreciated that swab cup 86 also helps to minimize the ingress of debris into flow diverter 10 as it is run into the well.

Slick joint 15 also comprises an enlargement or collar 16 so that transmission 90 may be actuated to move sleeve 84 to its closed position after a cementing operation is completed. This may be appreciated best by comparing FIG. 10A, which shows flow diverter 10 in its run-in position where ports 83 are open, to FIG. 10B, which shows diverter 10 after ports 83 have been closed.

More specifically, ports 83 may be closed by pulling up on work string 5 to which slick joint 15 is ultimately connected. As slick joint 15 travels upward, collar 16 will engage enlarged lower end 98 of carriage 91 and cause carriage 91 to move upwardly along with slick joint 15. At this point, since annular base 93 of collet 92 is releasably engaged with carriage 91 and enlarged ends 95 of collet fingers 94 are releasably engaged with sleeve 84, upward movement of carriage 91 will cause sleeve 84 to move upward to its closed position shown in FIG. 10B. Upper end of sleeve 84 is slotted, thus providing splines 87 that are able to flex to a limited degree and, via bosses (not shown), snap into an annular groove 88 on housing 80. Sleeve 84 is thereby secured in the closed position.

When transmission 90 has traveled upward to the point illustrated in FIG. 10B where sleeve 84 is in its closed position, enlarged ends 95 of collet fingers 94 engage upper end of slots 85 in housing 80. Applying further upward force to work string 5 and slick joint 15, therefore, will shear wire 96 and disengage collet 92 from carriage 91. Further upward movement of slick joint 15 will move enlarged end 98 of carriage 91 out from under flexible collet fingers 94 and into engagement with the lower shoulder of annular base 93 of collet 92. At this point, further upward movement of slick joint 15 and carriage 91, since collet fingers 94 now are able to flex, will cause enlarged collet ends 95 to ramp out of the recesses in sleeve 84 and slots 85 onto the inner surface of housing 80, thereby disengaging transmission 90 from sleeve 84. The entire transmission 90 then may be removed from flow diverter 10, leaving housing 80, with sleeve 84 secured in its closed position shutting off flow through ports 83, as part of installed liner 2.

Further details of the operation of the novel flow diverters and cementing operations are discussed below in the context of operating the liner assembly as a whole. It should already be appreciated, however, that the novel flow diverters provide significant advantages over the prior art. The housing of the novel flow diverters is designed to remain in the well as part of the installed liner. Thus, it is important that the flow diverter not only provide an effective and sealable flow path for returns, preferably it also does so without limiting either the effective inner diameter or outer diameter of the lining as a whole. By disposing the transmission within the housing, and by making it releasable from the cover and recoverable from the well, the novel tools provide a slim profile. The flow diverter, therefore, is well within the profile of the liner assembly as it is run into the well and, once the liner is completely installed, its inner diameter is at least as great as the liner as a whole. At the same time, other things being equal, the novel flow diverters are able to provide a relatively large flow path for returns during cementing operations and, when the transmission is removed, will not present a constriction in the installed liner. Operating a cover by an externally mounted transmission inevitably will require that the inner diameter of the housing be reduced for a given casing size, thus limiting the effective inner diameter of the installed liner or creating a constriction therein.

Moreover, unlike flow control devices for other well operations, the novel flow diverters comprise an opening designed to accommodate a slick joint or other conduit that extends through the diverter. Thus, cement or other work fluids may be delivered to those portions of the liner below the flow diverter without diverting injected fluids around the flow diverter. That also allows the novel tools to divert returns from a cementing operation without any prior actuation of the tool. A single operation to close the ports after actuation is all that is required.

It will be appreciated that the novel flow diverters are not limited to preferred flow diverter 10 discussed above. For example, enlarged portion 81 of slick joint 15 or other radially projecting pins and the like provide simple and effective means for mechanically engaging and manipulating transmission 90. Other mechanisms, however, may be provided for actuating the transmission of the novel flow diverters. For example, spring loaded dogs or pins may be mounted in recesses in a carriage so that they can engage slots, grooves and the like in a slick joint as it is pulled upwards. A ratchet assembly, similar to the ratchet ring 26 mounted between hanger mandrel 20 and swage 21, also may be provided between the carriage and slick joint to allow the slick joint to pick up the carriage as it is raised. Other components, such as the cement packoff, also may be used to engage a carrier as discussed below. Moreover, hydraulic cylinders could be connected to a carriage, or other mechanisms also could be provided for actuating the carriage instead of mechanically engaging and manipulating a slick joint.

Moreover, while sleeve 84 is adapted for upward axial movement, it will be appreciated that the covers of the novel flow diverters may be adapted to move downward and cover ports situated below the sleeve. Spring loaded pins or dogs could be provided as discussed above to mechanically engage a carriage and slick joint for downward movement. Pivotable dogs also could be provided on a slick joint. Such pivoting dogs could be situated below the flow diverter so that they swing in and under a carriage member as the slick joint is raised and then swing out into engagement with the carriage once they have cleared its upper edge and the slick joint is moved downward.

Similarly, other mechanisms may be provided in the novel flow diverters for releasably engaging the transmission to the cover. For example, a carrier could be releasably engaged with the cover directly by pins, screws, rings, or the like that would shear once the cover has traveled to its closed position. Radially displaceable dogs also could be mounted in J-slots in the carriage, similar to the manner in which dogs 48 are mounted in tubular section 31*g* as described below. Instead of a collet, a sleeve with pivotable or radially displaceable dogs could be slideably supported on, and releasably engaged with a carrier, the dogs being allowed to move out of engagement with the cover into recesses in the carrier once the carrier has traveled upwards a defined distance relative to the sleeve.

Likewise, sleeve 84 or other covers may be supported on the inner surface of the housing. It would not be necessary to provide slots in the housing, but otherwise an inner sleeve could be releasably engaged with and actuated by a transmission as described above. For example, as shown in FIG. 11, a second preferred embodiment 110 of the novel flow diverters comprises a sleeve 184 which is slidably supported on the inner surface of a housing 180. Diverter housing 180 is quite similar to housing 80 of diverter 10. It comprises a number of ports 183 which are configured and sized to allow fluid displaced during a cementing operation to flow into the interior of housing 180. Since sleeve 183 is supported on the inner surface of housing 184, however, housing 180 has a portion 181 with enlarged inner and outer diameters to accommodate sleeve 183. It also is not necessary to provide slots, such as slots 85 which are provided in housing 80.

Figure 11A:
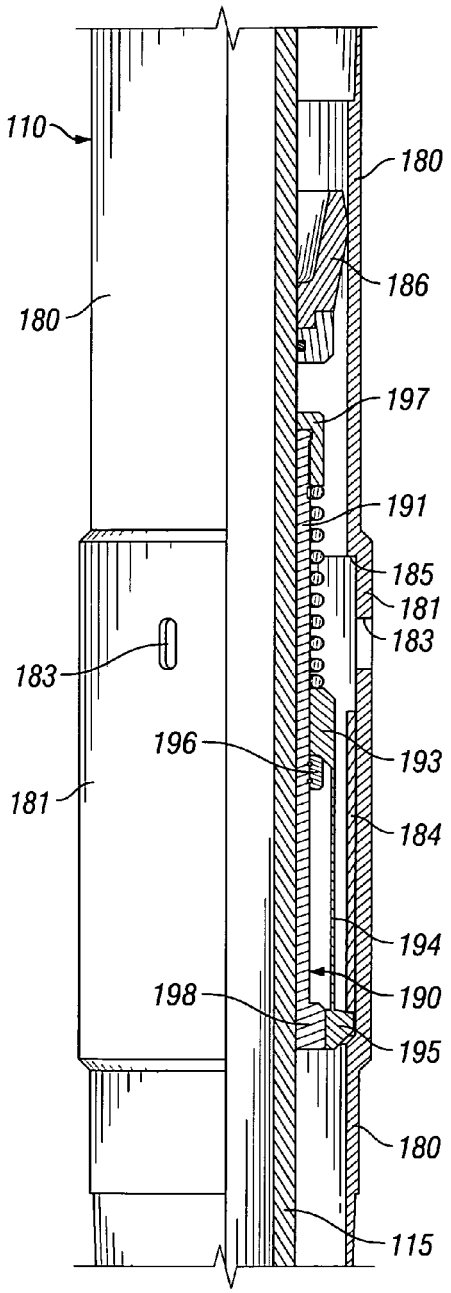
FIG. 11A is a quarter-sectional view of a second preferred embodiment 110 of the return flow diverters of the subject invention showing ports 183 and other details of flow diverter 110 in its run-in position.
Figure 11B:
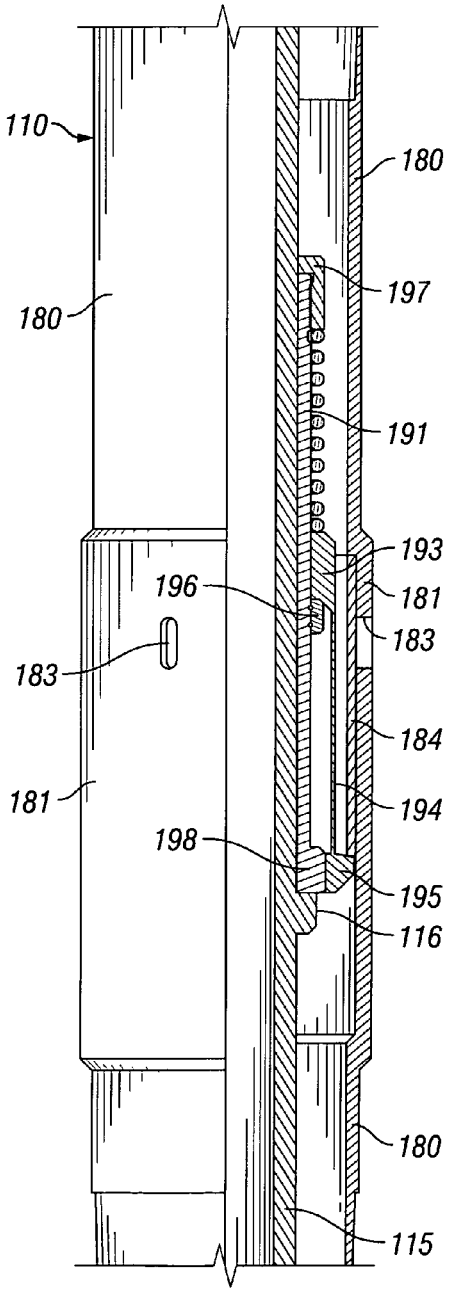
FIG. 11B is a view similar to FIG. 11A showing flow diverter 110 wherein ports 183 have been closed.

As will be appreciated by comparing FIGS. 11A and 11B, sleeve 184 is supported for axial movement from an open, run-in position, in which ports 183 are uncovered by sleeve 184 as shown in FIG. 11A, to a closed, installed position, in which sleeve 184 covers ports 183 as shown in FIG. 11B. Sleeve 184 is releasably connected to and operated by a transmission 190 which is substantially identical to transmission 90 in diverter 10. Thus, those components, and other similar components of flow diverter 110 are identified by 100-series reference numbers comparable to the reference numbers used in describing flow diverter 10 above.

Transmission 190, as may be seen in FIG. 11, comprises a carriage 191 and a collet 192. The enlarged ends 195 of collet fingers 194 engage corresponding recesses in sleeve 184. They are prevented from flexing out of engagement with sleeve 184 by an enlarged lower portion 198 of carriage 191. Thus, collet 192 engages sleeve 184 when flow diverter 110 is run into the well.

As in diverter 10 discussed above, ports 183 in diverter 110 are closed by raising slick joint 115, which causes its collar 116 to engage enlarged lower end 198 of carriage 191. Further pulling on slick joint 115 causes carriage 191 and collet 192 to travel upward, carrying sleeve 184 up to its closed position shutting off housing ports 183.

When transmission 190 has traveled upward to the point illustrated in FIG. 11B where sleeve 184 is in its closed position, the upper end of sleeve 184 engages a shoulder 185 formed by the enlarge portion 181 of housing 180. Applying further upward force to work string 5 and slick joint 115, therefore, will shear wire 196 and disengage collet 192 from carriage 191. Further upward movement of slick joint 15 will move enlarged end 198 of carriage 191 out from under flexible collet fingers 194 and into engagement with the lower shoulder of annular base 193 of collet 192. At this point, further upward movement of slick joint 115 and carriage 191, since collet fingers 194 now are able to flex, will cause enlarged collet ends 195 to ramp out of the recesses in sleeve 184 onto the inner surface of sleeve 184, thereby disengaging transmission 190 from sleeve 184. The entire transmission 190 then may be removed from flow diverter 10, leaving housing 180, with sleeve 184 secured in its closed position shutting off flow through ports 183, as part of installed liner 2.

Covers also may be supported on the diverter housing for relative axial movement via threads as in, for example, another preferred embodiment 210 shown in FIG. 12. Preferred flow diverter 210 comprises a sleeve 284 which is supported within a housing 280. They are similar in construction to sleeve 184 and housing 180 in flow diverter 110. Sleeve 284 and housing 280 in diverter 210, however, are engaged via mating threads 289. Otherwise, diverter housing 280 is substantially the same as housing 180 of diverter 110. It comprises a number of ports 283 which are configured and sized to allow fluid displaced during a cementing operation to flow into the interior of housing 280.

Figure 12A:
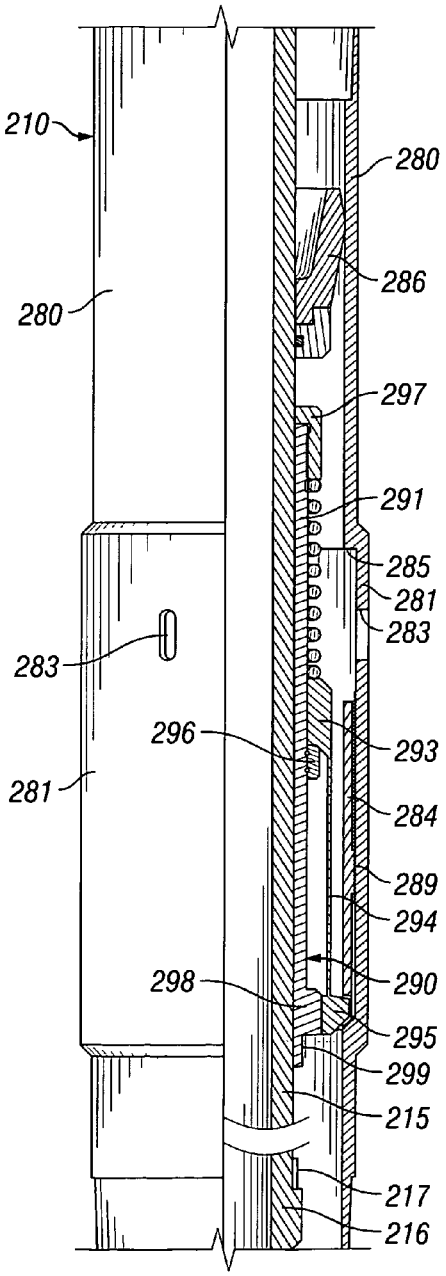
FIG. 12A is a quarter-sectional view of a third preferred embodiment 210 of the return flow diverters of the subject invention showing ports 283 and other details of flow diverter 210 in its run-in position.
Figure 12B:
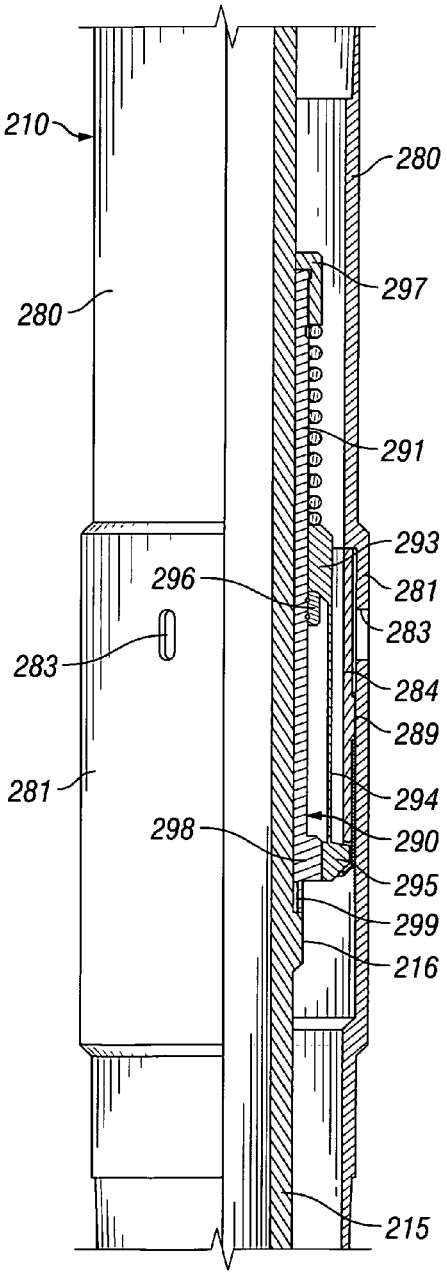
FIG. 12B is a view similar to FIG. 12A showing flow diverter 210 wherein ports 283 have been closed.

As will be appreciated by comparing FIGS. 12A and 12B, sleeve 284 is supported for axial movement, via rotation through mating threads 289, from an open, run-in position, in which ports 283 are uncovered by sleeve 284 as shown in FIG. 12A, to a closed, installed position, in which sleeve 284 covers ports 283 as shown in FIG. 12B. Sleeve 284 is releasably connected to a transmission 290 which is operable to move sleeve 284 from its open to its closed positions.

Transmission 290, as may be seen in FIG. 12, comprises a carriage 291 and a collet 292. The enlarged ends 295 of collet fingers 294 engage corresponding recesses in sleeve 284. They are prevented from flexing out of engagement with sleeve 284 by an enlarged lower portion 298 of carriage 291. Thus, collet 292 engages sleeve 284 when flow diverter 210 is run into the well.

Enlarged end 298 of carriage 291, however, is provided with a series of circumferentially spaced splines 299, which as may be seen in FIG. 12B, mate with circumferentially spaced splines 217 on slick joint collar 216 when slick joint 215 is raised. When splines 299 and 217 are engaged, slick joint 215 may be rotated via workstring 5, which will in turn rotate transmission 290 and move sleeve 284 upward to close ports 283.

When transmission 290 has traveled upward to the point illustrated in FIG. 12B where sleeve 284 is in its closed position, the upper end of sleeve 284 engages a shoulder 285 formed by the enlarge portion 281 of housing 280. Applying further upward force to work string 5 and slick joint 215, therefore, will shear wire 296 and disengage collet 292 from carriage 291. Further upward movement of slick joint 215 will move enlarged end 298 of carriage 291 out from under flexible collet fingers 294 and into engagement with the lower shoulder of annular base 293 of collet 292. At this point, further upward movement of slick joint 215 and carriage 291, since collet fingers 294 now are able to flex, will cause enlarged collet ends 295 to ramp out of the recesses in sleeve 284 onto the inner surface of sleeve 284, thereby disengaging transmission 290 from sleeve 284. The entire transmission 290 then may be removed from flow diverter 210, leaving housing 280, with sleeve 284 secured in its closed position shutting off flow through ports 283, as part of installed liner 2.

Other covers may be adapted for rotational movement by providing pins on the slick joint which engage helical grooves in the inner surface of the carriage. Such rotating covers would be provided with ports that align with the ports in the tool housing when the cover is in its open position and rotate out of alignment in the closed position. Additionally, as exemplified by a fourth preferred embodiment shown in FIGS. 13A and 13B, collet ends 395 may engage coarse threads or helical grooves 399 on the inner surface of sleeve 384. More particularly, preferred embodiment 310 of the novel flow diverters comprises a sleeve 384 which is slidably supported on the inner surface of a housing 380. Diverter housing 380 is quite similar to housing 180 of diverter 110. It comprises a number of ports 383 which are configured and sized to allow fluid displaced during a cementing operation to flow into the interior of housing 380.

Figure 13A:
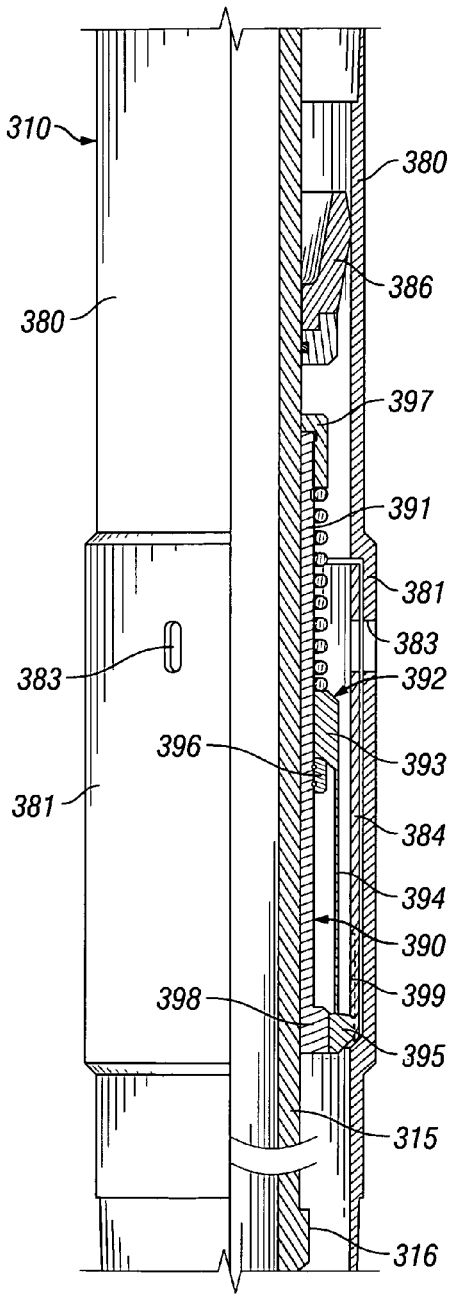
FIG. 13A is a quarter-section view of a fourth preferred embodiment 310 of the return flow diverters of the subject invention showing ports 383 and other details of flow diverter 310 is its run-in position.

Unlike sleeves 80, 180, and 280 in, respectively, diverters 10, 110, and 210, sleeve 384 in diverter 310 is provided with a series of ports 389 which align with ports 383 in housing 380 when sleeve 384 is in an open, run-in position, as shown in FIG. 13A. As will be appreciated by comparing FIGS. 13A and 13B, sleeve 384 is supported for rotational movement from its open, run-in position, in which sleeve ports 389 align with housing ports 383 as shown in FIG. 13A, to a closed, installed position, in which sleeve ports 389 have rotated out of alignment with housing ports 383 such that they are closed as shown in FIG. 13B.

Sleeve 384 is releasably connected to and operated by a transmission 390 which is similar to transmissions 90 and 190 in, respectively, diverters 10 and 110. Transmission 390 comprises a carriage 391 and a collet 392 which are releasably engaged by, for example, shear wire 396. The enlarged ends 395 of collet fingers 394, however, extend into and engage helical grooves 399 on inner surface of sleeve 384. They are prevented from flexing out of engagement with sleeve 384 by an enlarged lower portion 398 of carriage 391. Thus, collet 392 engages sleeve 384 when flow diverter 310 is run into the well.

As in diverters 10, 110, and 210 discussed above, ports 383 in diverter 310 are closed by raising slick joint 315, which causes its collar 316 to engage enlarged lower end 398 of carriage 391. Further pulling on slick joint 315, however, causes ends 396 of collet fingers 394 to travel through grooves 399, which in turn causes sleeve 384 to rotate into its closed position shutting off housing ports 383.

Figure 13B:
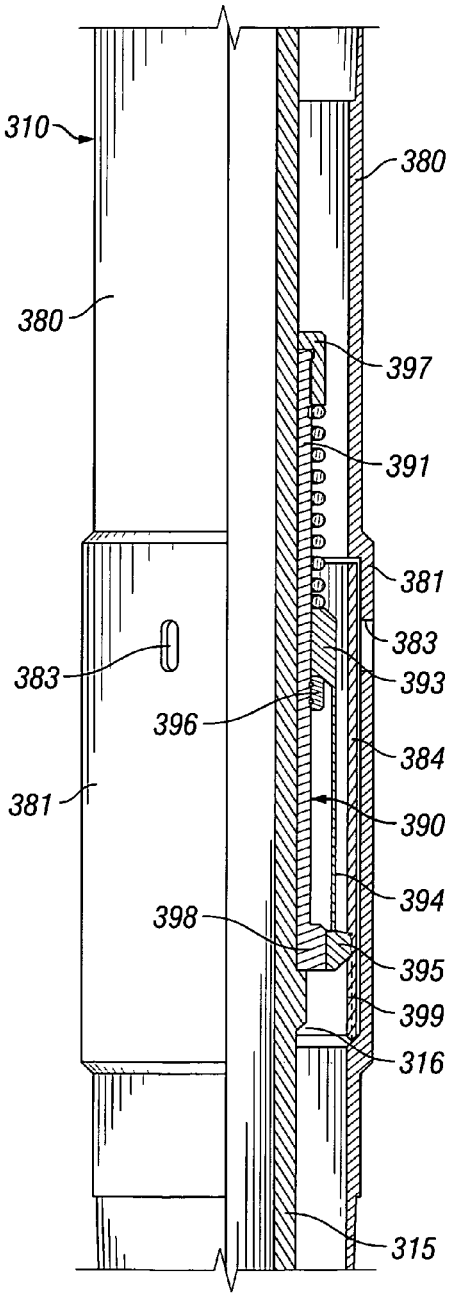
FIG. 13B is a view similar to FIG. 13A showing flow diverter 310 wherein ports 383 have been closed.

When transmission 390 has traveled upward to the point illustrated in FIG. 13B where sleeve 384 is in its closed position, enlarged ends 395 of collet fingers 394 engage upper end of helical grooves 399. Applying further upward force to work string 5 and slick joint 315, therefore, will shear wire 396 and disengage collet 392 from carriage 391. Further upward movement of slick joint 315 will move enlarged end 398 of carriage 391 out from under flexible collet fingers 394 and into engagement with the lower shoulder of annular base 393 of collet 392. At this point, further upward movement of slick joint 315 and carriage 391, since collet fingers 394 now are able to flex, will cause enlarged collet ends 395 to ramp out of the helical grooves 399 in sleeve 384 onto the inner surface of sleeve 384, thereby disengaging transmission 390 from sleeve 384. The entire transmission 390 then may be removed from flow diverter 310, leaving housing 380, with sleeve 384 secured in its closed position shutting off flow through ports 383, as part of installed liner 2.

Figure 14A:
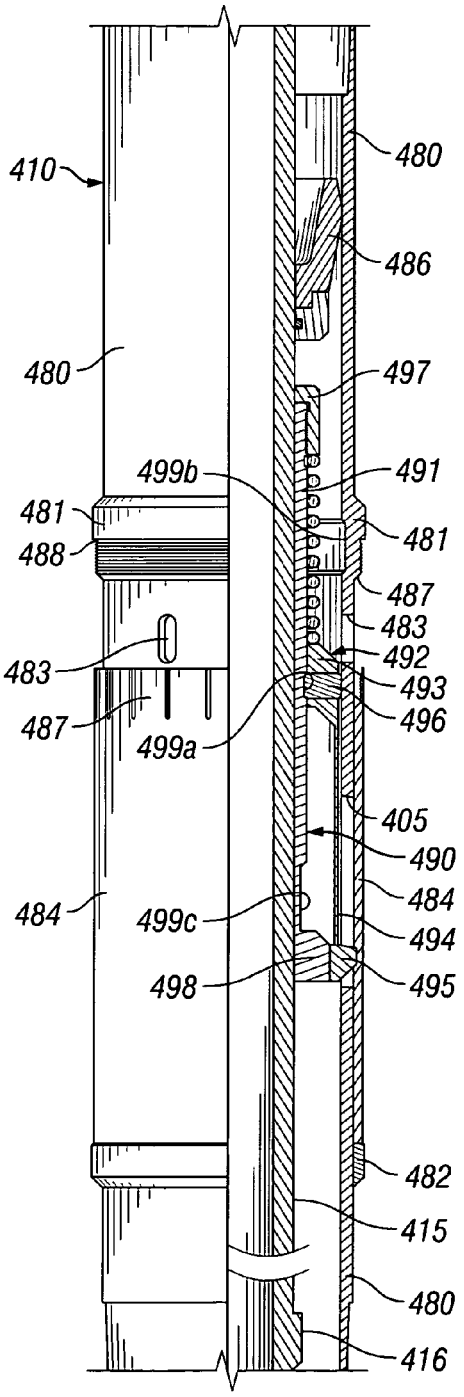
FIG. 14A is a quarter-sectional view of a fifth preferred embodiment 410 of the return flow diverters of the subject invention showing ports 483 and other details of flow diverter 410 in its run-in position.
Figure 14B:
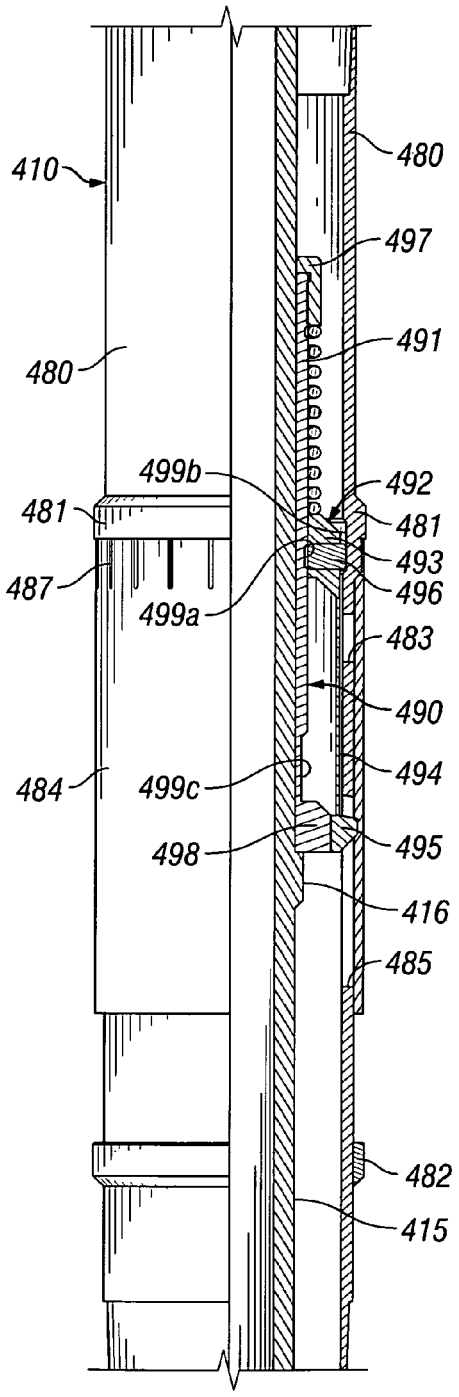
FIG. 14B is a view similar to FIG. 14A showing flow diverter 410 wherein ports 483 have been closed.

As noted above, the collet in the various preferred embodiments may be releasably engaged with the carriage by a variety of mechanisms. In preferred embodiments 10, 110, 210, and 310 it is provided, respectively, by shear wires 96, 196, 296, and 396. As a further example, and as shown in FIGS. 14A and 14B, that releasable engagement may be provided by radially displaceable dogs. More particularly, diverter 410 comprises a sleeve 484 which is slidably supported on the inner surface of a housing 480. Diverter housing 480 is quite similar to housing 80 of diverter 10. It comprises a number of ports 483 which are configured and sized to allow fluid displaced during a cementing operation to flow into the interior of housing 480.

As will be appreciated by comparing FIGS. 14A and 14B, sleeve 484 is supported for axial movement from an open, run-in position, in which ports 483 are uncovered by sleeve 484 as shown in FIG. 14A, to a closed, installed position, in which sleeve 484 covers ports 483 as shown in FIG. 14B. Sleeve 484 is releasably connected to and operated by a transmission 490 which is similar to transmission 90 in diverter 10. Transmission 490 comprises a carriage 491 and a collet 492 which are releasably engaged. In transmission 490, however, carriage 491 and collet 492 are releasably engaged via dogs 496.

Dogs 496 are carried in suitably configured slots in annular base 93 of collet 492. When diverter 410 is in its run-in position, as shown in FIG. 14A, dogs 496 engage an annular recess 499*a* in carriage 491, thus engaging carriage 491 and collet 492. After cementing, then, when slick joint 415 is raised such its collar 416 engages enlarged lower end 498 of carriage 491, further pulling on slick joint 415 will cause sleeve 484 to move upward to its closed position shown in FIG. 14B.

When transmission 490 has traveled upward to the point illustrated in FIG. 14B where sleeve 484 is in its closed position, dogs 496 will be in alignment with the lower portion of an annular recess 499*b* provided in the inner surface of housing 480. Applying further upward force to work string 5 and slick joint 415, therefore, will urge dogs 496 into recess 499*b* and out of engagement with carriage 491.

Further upward movement of slick joint 415 will move enlarged end 498 of carriage 491 out from under flexible collet fingers 494 and into engagement with the lower shoulder of annular base 493 of collet 492. At this point, dogs 496 will be in alignment with an annular recess 499*c* provided toward the lower end of carriage 491. Further upward movement of slick joint 415 and carriage 491, will allow dogs 496 to move into recess 449*c* and out of engagement with recess 499*b* in housing 480. At the same time, since collet fingers 494 now are able to flex inward, that upward movement will cause enlarged collet ends 495 to ramp out of the recesses in sleeve 484 and slots 485 onto the inner surface of sleeve 484, thereby disengaging transmission 490 from sleeve 484. The entire transmission 490 then may be removed from flow diverter 410, leaving housing 480, with sleeve 484 secured in its closed position shutting off flow through ports 483, as part of installed liner 2.

It also will be appreciated that while greatly preferred in view of the advantages discussed above, various aspects of the subject invention may be practiced without use of the novel flow diverters. For example, the novel methods of installing a liner generally do not require use of the novel flow diverters, only that a port be provided in the liner downhole of the seal established between the liner and annulus and, preferably, that some means are provided for closing the port after cementing has been completed.

Operation of Liner Assembly

Liner assembly 1 is assembled with liner hanger 11, anchor installation tool 3, and flow diverter 10 in their run-in positions. It then may be lowered on work string 5 into existing casing 6, with or without rotation. If a liner is being installed, however, a drill bit preferably is attached to the end of the liner, as noted above, so that the liner may be drilled in.

Work string 5 provides a conduit for circulation of fluids as may be needed for drilling or other operations in the well. It also provides for transmission of axial and rotational forces as are required to operate installation tool 3, flow diverter 10, and other components of liner assembly 1. In that context, then, work string 5 will be understood to include not only the tubular members from which liner assembly 1 is suspended, but also tool mandrel 30, slick joint 15, and any other tubulars or connectors which cooperate to provide a conduit or transmit operational forces.

Once liner assembly 1 has been positioned at the desired depth, liner hanger 11 will be set in existing casing 6 and released, liner 2 will be cemented in the well, and anchor installation tool 3 will be retrieved from the well, as now will be described in greater detail.

Liner hanger 11 is set by increasing the fluid pressure within mandrel 30. Thus, liner assembly 1 preferably includes a ball seat (not shown) which is connected either directly or via tubular connections to slick joint 15 below flow diverter 10 and cement packoff 14. A ball may be dropped through work string 5 and allowed to settle on the ball seat. Once it is on the seat, the ball effectively shuts off work string 5 and allows pressure to build above the ball. After liner hanger 11 has been set, pressure is increased further to blow the ball past the seat.

The subject invention, however, is not limited to such mechanisms. Other mechanisms, such as blowable flapper valves, may be provided to shut off a work string and allow pressure to be built up in an installation tool. The liner also may be cemented in the well bore, and the cement in the annulus will shut off flow from the liner and allow pressure to be increased in the work string to set the anchor. As noted, however, there are important benefits in setting and releasing an anchor before the liner is cemented which may be realized by preferred aspects of the subject invention.

In any event, as fluid pressure increases in tool mandrel 30 setting tool 13 is actuated, urging swage 21 downward and under expandable sleeve 22. At the same time, increasing fluid pressure in mandrel 30 causes a partial release of running tool 12 from mandrel 30. Once running tool 12 is in this set position, running tool 12 may be released from liner hanger 11 by releasing weight on mandrel 30 through work string 5. Alternately, in the event that release does not occur, running tool 12 may be released from liner hanger 11 by rotating mandrel 30 a quarter-turn counterclockwise prior to releasing weight.

More particularly, as fluid pressure in mandrel 30 is increased to actuate setting tool 13 and set liner hanger 11, fluid enters bottom hydraulic chambers 64 of actuators 60 through inlet ports 65. The increasing fluid pressure in bottom hydraulic chambers 64 urges floating pistons 61*b* through 61*f* downward. Because floating pistons 61 and sleeves 62 are all interconnected, that force is transmitted throughout all actuators 60, and whatever shear members have been employed to immobilize actuators 60 are sheared, allowing actuators 60 to begin moving downward. That downward movement in turn causes an increase in pressure in top hydraulic chambers 66 which eventually ruptures diaphragms 73, allowing fluid to flow through balance pistons 70. Continuing flow of fluid into bottom hydraulic chambers 64 causes further downward travel of actuators 60. Since fluid communication has been established in passageways 72, balance pistons 70 are urged downward along mandrel 30 with floating pistons 61, as may be seen by comparing FIGS. 2A and 2B.

Figure 3A:
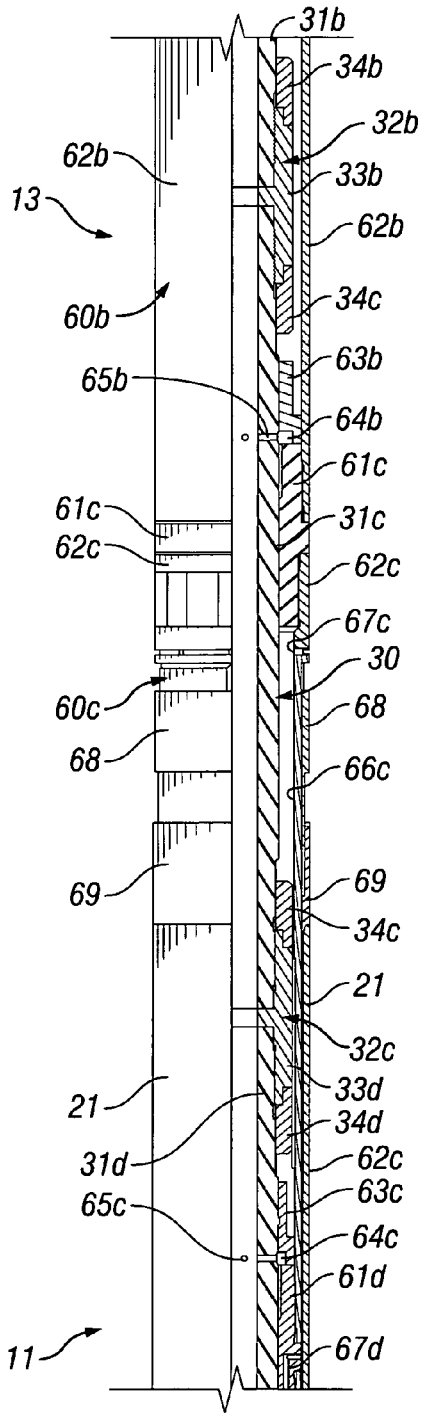
FIG. 3A is an enlarged quarter-sectional view generally corresponding to section B of liner assembly 1 shown in FIG. 1A showing additional details of setting tool 13 and portions of liner hanger 11 in their run-in position.
Figure 3B:
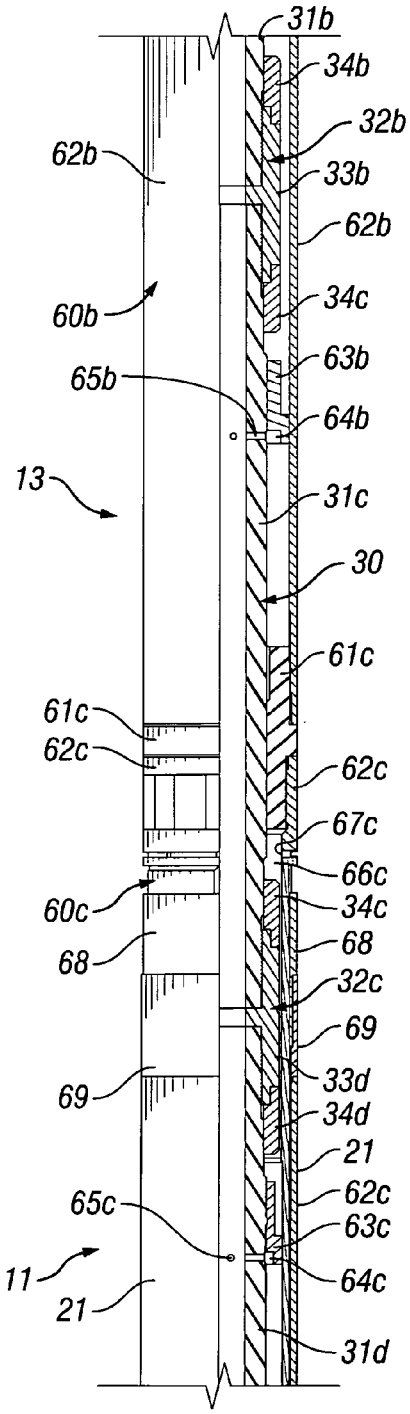
FIG. 3B is a view similar to FIG. 3A showing setting tool 13 and liner hanger 11 in their-set position.

As actuators 60 continue traveling downward along mandrel 30, as best seen by comparing FIGS. 3A and 3B, the shear pins connecting adjusting collar 68 and stop collar 69 are sheared. The lower end of adjusting collar 68 then moves into engagement with the upper end of stop collar 69, which in turn abuts swage 21. Thus, downward force generated by actuators 60 is brought to bear on swage 21, causing it to move downward and, ultimately, to expand metal sleeve 22 radially outward into contact with an existing casing. It will be appreciated that ideally there is little or no movement of liner hanger 11 relative to the existing casing as it is being set. Thus, a certain amount of weight may be released on mandrel 30 to ensure that it is not pushed up by the resistance encountered in expanding sleeve 22.

Finally, as noted above, the increasing fluid pressure within mandrel 30 not only causes setting of liner hanger 11, but also causes a partial release of running tool 12 from mandrel 30. More specifically, as understood best by comparing FIGS. 6A and 6B, increasing fluid pressure in mandrel 30 causes fluid to pass through one or more ports 51 in tubular section 31*g* into a small hydraulic chamber 52 defined between locking piston 50 and annular seals 53 provided between piston 50 and section 31*g*. As fluid flows into hydraulic chamber 52, locking piston 50 is urged upward along tubular section 31*g* and away from dog housing 47.

That movement of locking piston 50 uncovers recesses in dog housing 47. As discussed above, dogs 48 are able to move radially (to a limited degree) within those recesses. Once uncovered, however, dogs 48 will be urged outward and out of engagement with tubular section 31*g* if mandrel 30 is moved downward. Thus, running tool 12 is partially released from mandrel 30 in the sense that mandrel 30, though restricted from relative upward movement, is now able to move downward relative to running tool 12. Other mechanisms for setting and releasing dogs, such as those including one or a combination of mechanical or hydraulic mechanisms, are known, however, and may be used in running tool 12.

Once liner hanger 11 has been set and any other desired operations are completed, running and setting tools 12 and 13 may be completely released from liner hanger 11 by first moving them to their "release" positions. FIGS. 6C and 7C show running tool 12 in its release position. As will be appreciated therefrom, in general, running tool 12 is released from hanger 11 by releasing weight onto mandrel 30 via work string 5 while fluid pressure within mandrel 30 is reduced. Thus, as weight is released onto mandrel 30 it begins to travel downward and setting tool 13, which is held stationary by its engagement through stop collar 69 with the upper end of swage 21, is able to ride up mandrel 30.

Figure 6B:
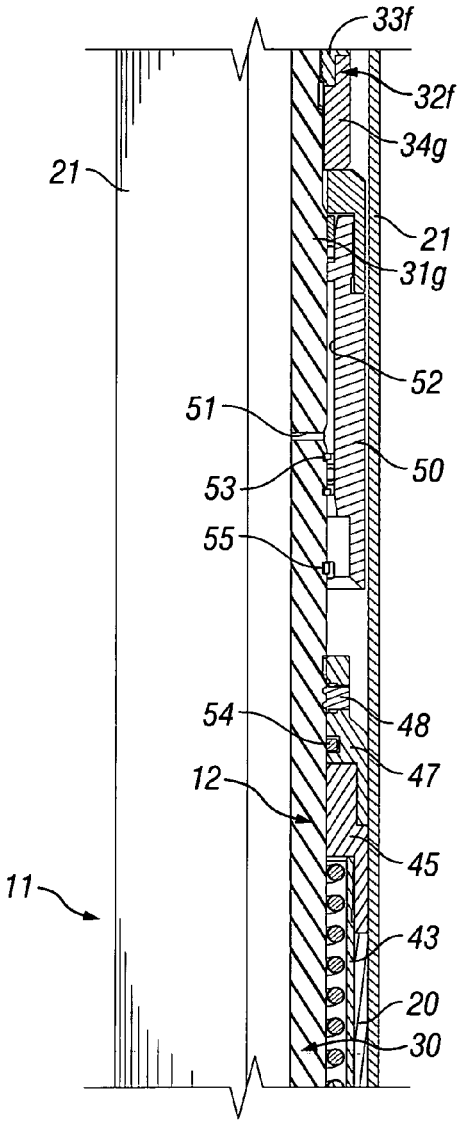
FIG. 6B is a view similar to FIG. 6A showing running tool 12 and liner hanger 11 in their set position.
Figure 6C:
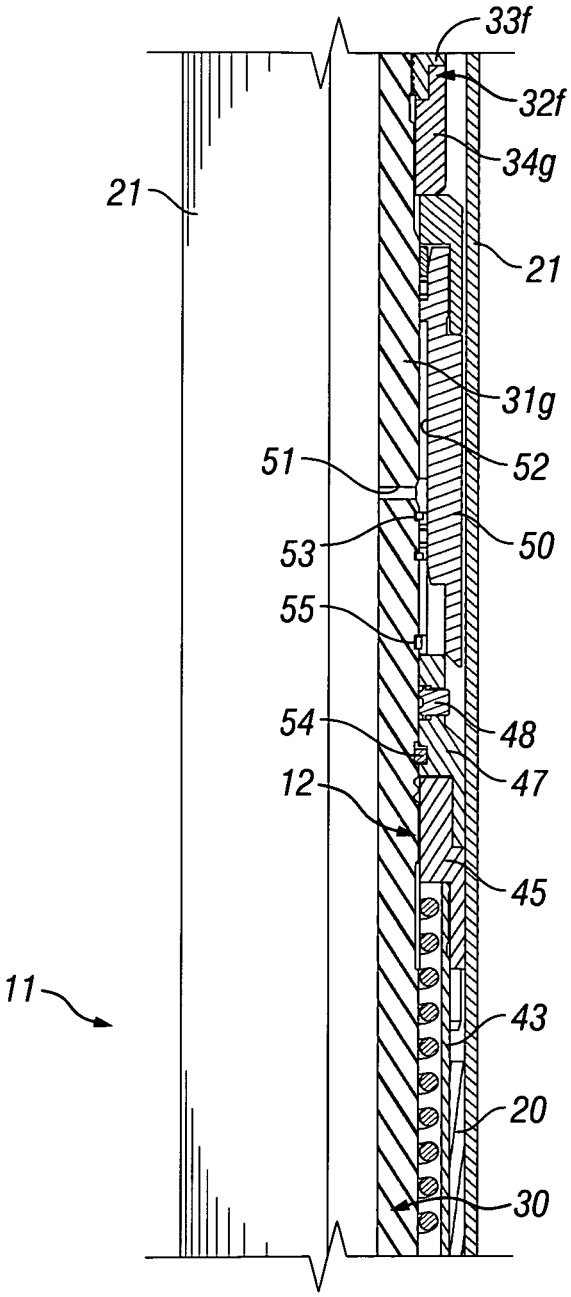
FIG. 6C is a view similar to FIGS. 6A and 6B showing running tool 12 and liner hanger 11 in their release position.

As best seen by comparing FIG. 6B and FIG. 6C, at the same time dogs 48 now are able to move radially out of engagement with tubular section 31*g* as discussed above, and as weight is released onto liner assembly 1 mandrel 30 is able to move downward relative to running tool 12. An expanded C-ring 54 is carried on the outer surface of tubular section 31*g* in a groove in dog housing 47. As mandrel 30 travels downward, expanded C-ring 54 encounters and is able to relax somewhat and engage another annular groove in tubular section 31*g*, thus laterally re-engaging running tool 12 with tool mandrel 30. The downward travel of mandrel 30 preferably is limited to facilitate this re-engagement. Thus, an expanded C-ring and cover ring assembly 55 is mounted on tubular section 31*g* such that it will engage the upper end of dog housing 47, stopping mandrel 30 and allowing expanded C-ring 54 to engage the mating groove in tubular section 31*g*.

Figure 7B:
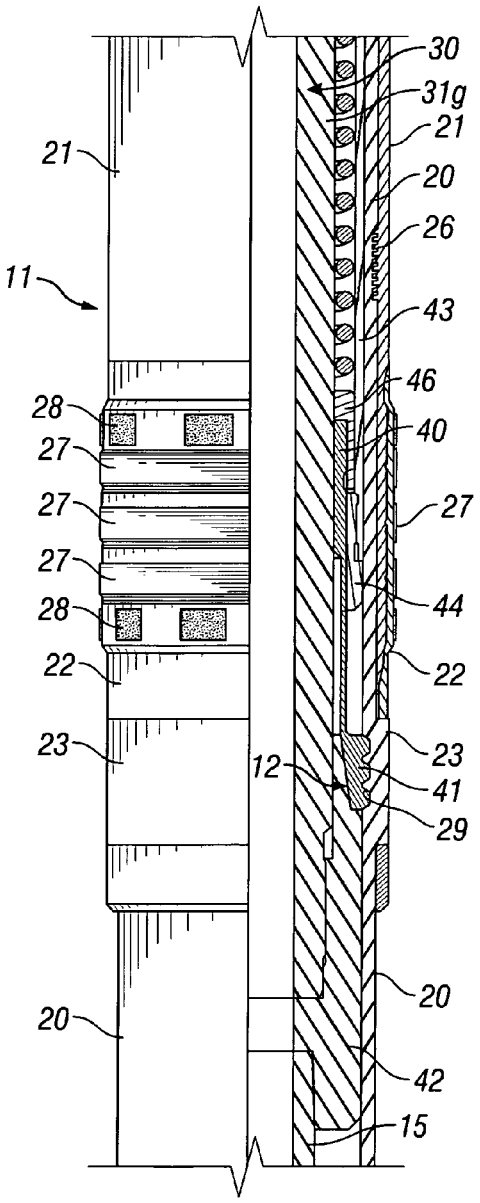
FIG. 7B is a view similar to FIG. 7A showing liner hanger 11 and running tool 12 in their set position.
Figure 7C:
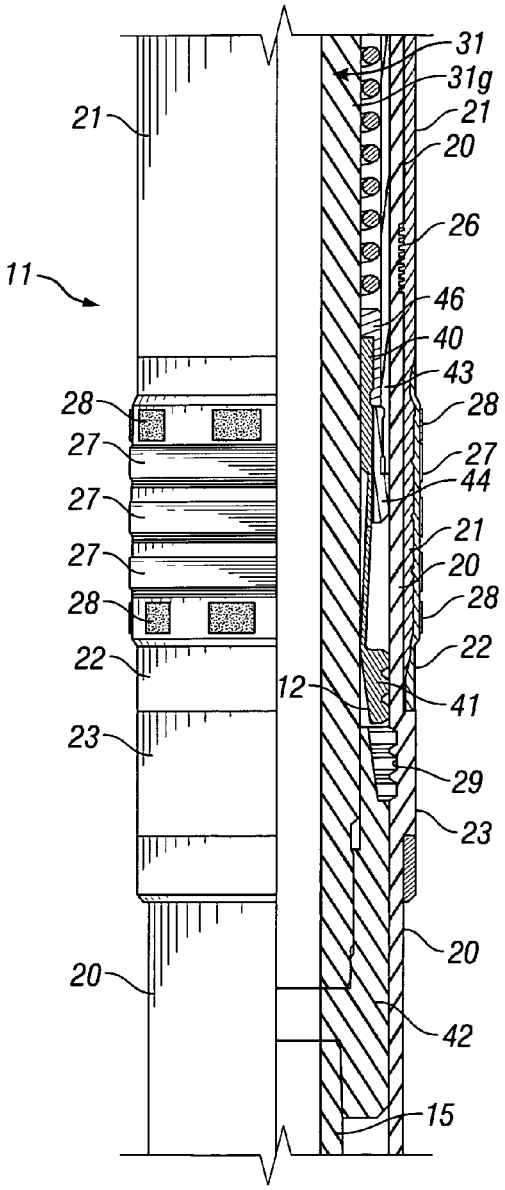
FIG. 7C is a view similar to FIGS. 7A and 7B showing liner hanger 11 and running tool 12 in their release position.
Figure 7D:
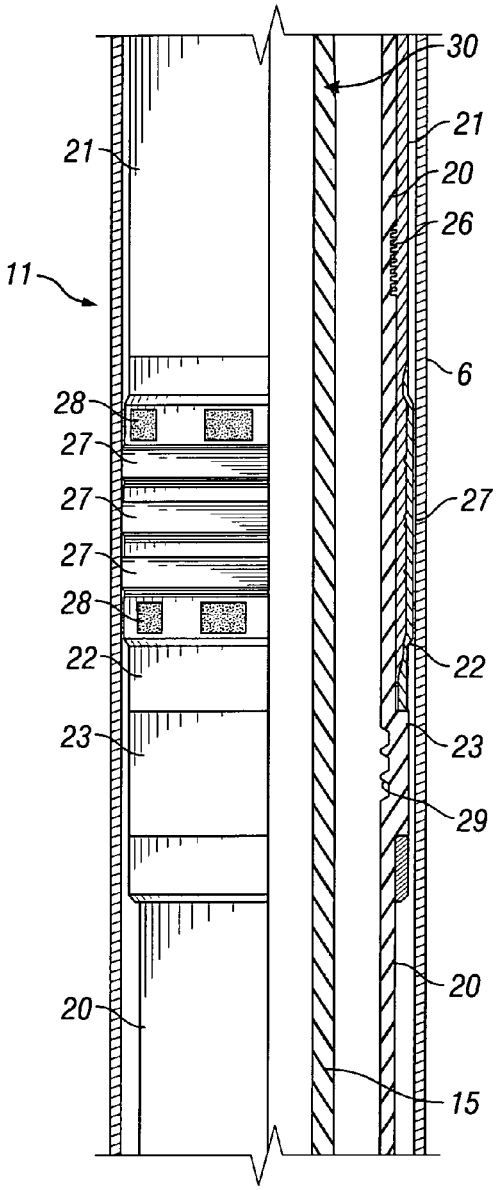
FIG. 7D is a view similar to FIGS. 7A to 7C showing liner hanger 11 and running tool 12 in a partially withdrawn position.

Finally, as best seen by comparing FIGS. 7B and 7C, downward travel of mandrel 30 will cause bottom collar 42 to travel downwards as well, thereby removing radial support for collet ends 41. Running and setting tools 12 and 13 then may be retrieved by raising mandrel 30 via work string 5. As noted, running tool 12 has been re-engaged with tool mandrel 30. When mandrel 30 is raised, therefore, collet 40 is raised as well. Collet ends 41 are tapered such that they will be urged radially inward as they come into contact with the upper edges of annular recesses 29 in hanger mandrel 20, thereby releasing running tool 12 from hanger 11. Setting tool 13 is carried along on mandrel 30.

In the event running tool 12 is not released from mandrel 30 as liner hanger 11 is set, it will be appreciated that it may be released by rotating mandrel 30 a quarter-turn counterclockwise and then releasing weight on mandrel 30. That is, left-handed "J" slots (not shown) are provided in tubular section 31*g*. Such "J" slots are well known in the art and provide an alternate method of releasing running tool 12 from hanger mandrel 20. More specifically, dogs 48 may enter lateral portions of the "J" slots by rotating mandrel 30 a quarter-turn counterclockwise. Upon reaching axial portions of the slots, weight may be released onto mandrel 30 to move it downward relative to running tool 12. That downward movement will re-engage running tool 12 and remove radial support for collet ends 41 as described above. Preferably, shear wires or other shear members are provided to provide a certain amount of resistance to such counterclockwise rotation in order to minimize the risk of inadvertent release.

Installation tool 3 may be retrieved from the well once it has been completely released from liner hanger 11 if desired. Preferably, however, as provided by other aspects of the subject invention, the seal established between the existing casing and liner hanger by the anchor is pressure tested.

That is, as noted above, the novel diverters also preferably incorporate a one-way seal, such as swab cup 86 on diverter 10 shown in FIG. 10A. Swab cup 86 is mounted on slick joint 15 at a point above ports 83 and provides a one-way seal between slick joint 15 and housing 80. Swab cup 86 may be mounted on housing 80, but if so, it generally would be regarded as necessary to perform a drilling operation or provide a release mechanism so that swab cup 86 eventually may be removed from diverter 10. In any event, swab cup 86 allows fluid to flow through housing 80 in an upward direction past swab cup 86, but will substantially prevent fluid flow in a downward direction. Once liner hanger 11 has been set, back pressure may be applied to the well to test the seal. That is, pressure may be increased in the annulus between work string 5 and existing casing 6. Swab cup 86 will prevent fluid from flowing downward between slick joint 15 and housing 80. Thus, any loss of pressure in the annulus (assuming the integrity of the existing casing) would indicate that an effective seal was not established when liner hanger 11 was set.

It will be appreciated that the pressure test may be conducted prior to or after release of the installation tool from the liner hanger. Especially if a pressure test is conducted before the installation tool is released from the liner hanger, it may be possible to repair or improve the seal by further manipulation of the installation tool. It also will be appreciated that a one-way seal, such as a swab cup, may be provided at other points above the ports in the novel diverter. It need not necessarily be disposed (in its run-in position) between the slick joint and the housing of the novel diverters. It may be located above the diverter in other portions of the liner.

As provided by other preferred aspects of the subject invention, the liner also may be completely installed and cemented in a single trip into the well. In accordance therewith, the anchor is set and sealed to an existing casing, and the installation tool is released and translated a sufficient distance to provide a path for fluid flow through the anchor.

That is, tool mandrel 30 and slick joint 15 pass through liner hanger 11 and flow diverter 10 and allow cement to be introduced into liner 2 below flow diverter 10. Cement packoff 14 is incorporated into liner assembly 1 below flow diverter 10. It includes conventional packing elements which are disposed between its outer housing, which will be left in the well as part of liner 2, and slick joint 15, which extends therethrough. Cement packoff 14 thus establishes a seal around slick joint 15 that will prevent cement introduced through work string 5 from flowing up liner 2 into flow diverter 10. Cement packoff 14 preferably has drillable packings or, more preferably, packings that are retrievable by slick joint 15. The packing may be settable or pre-set. If it is settable, the packing will be set before cement is introduced into the well. A retrievable packing, if desired, could provide a convenient enlargement on slick joint 15 that could be used to actuate transmission 90 of flow diverter 10 as slick joint 15 is raised. A variety of conventional cement packoffs are available commercially and may be used in the novel liner assemblies. The subject invention in not limited to any particular packoff.

After the desired quantity of cement has been introduced, additional fluids are pumped in behind the cement "plug," usually separated by a wiper dart (not shown). The wiper dart will travel down work string 5 until it lands and seats on a liner wiper plug (not shown) which is attached to the end of work string 5. Continued pumping will cause the liner wiper plug to travel down liner 2 and the cement plug below it to flow out the lower end of liner 2.

As cement flows into liner 2 and the well annulus it will displace fluid already present in the annulus. Those return fluids, however, are not able to flow directly up the annulus to the surface since setting of liner hanger 11 will have established an annular seal with casing 6. Instead, returns will flow through ports 83 in flow diverter 10 and back inside liner 2.

Anchor installation tool 3, when it is in its run-in position and even after release, substantially occupies the space between tool mandrel 30 and liner hanger 11. While not necessarily fluid tight, it will prevent flow of substantial volumes of fluid in either direction through liner assembly 3. In any event, installation tool 3 will not allow sufficient flow to accommodate the volume and rate of fluid displaced during a typical cementing operation. Thus, before cement is introduced into work string 5, installation tool 3 will be completely released, by either method described above, and raised up a relatively short distance to provide a flow path through liner hanger 11.

For example, installation tool 3 may be pulled up to a point where running tool 12 has cleared swage 21, or at least dog housing 47 and thrust cap 45 have cleared swage 21. At this point, an annular clearance will be established between running tool 12 and casing 6 and swage 21. Slick joint 15 also will have been raised until it extends though hanger mandrel 20 and swage 21. Since slick joint 15 has an outer diameter less than the inner diameter of hanger mandrel 20 and swage 21, an annular flow path will be created through liner hanger 11 to existing casing 6. Thus, return fluids are able to flow up the lower annulus, through flow diverter 10, through liner 2 and liner hanger 11, into casing 6, and ultimately to the surface. It will be appreciated that slick joint 15 is sufficiently long so that it will still extend through flow diverter 10 and cement packoff 14 when installation tool is raised.

Once cementing is completed, ports 83 in flow diverter 10 may be closed by pulling up on work string 5. As work string 5 is pulled up, collar 16 on slick joint 15 will engage the lower end of carriage 91 in flow diverter 10. Continued pulling of work string 5 will first cause transmission 90 to raise diverter sleeve 84 and close ports 83 in flow diverter 10 and then to release transmission 90 from sleeve 84 and housing 80, all as described in detail above. Once ports 83 have been closed and transmission 90 released, transmission 90, installation tool 3, and other liner assembly components on work string 5 may be retrieved from the well. Housing 80 of flow diverter 10, its ports 83 having been closed, remains in the well as part of liner 2. Thus, it now is not only possible to completely install a liner in a well in a single trip, but to ensure that the hanger has been properly set, that an effective seal has been established, and that the hanger has been released before the liner is cemented.

It will be appreciated that the other preferred embodiments of the novel diverters may be used in substantially the same manner, appreciating of course that the diverter may be closed by different manipulations of the work string. For example, as discussed above in reference to preferred diverter 210, closure is accomplished by rotating the work string.

While this invention has been disclosed and discussed primarily in terms of specific embodiments thereof, it is not intended to be limited thereto. Other modifications and embodiments will be apparent to the worker in the art.

What is claimed is:

1. A method for installing and cementing a liner in a well, said method comprising:

(a) running said liner into said well on a work string, (b) anchoring said liner to an existing casing in said well;

(c) sealing said liner to said existing casing, said seal substantially preventing direct fluid flow around said liner to said existing casing from the annulus between said liner and said well;

(d) releasing said liner from said work string;

(e) raising said work string to provide a flow path inside said liner;

(f) after completing the preceding steps, injecting cement into said liner and allowing said cement to flow into said annulus;

(g) returning fluid displaced from said annulus by said cement through a port in said liner, said port being disposed downhole of said seal, and thence through said flow path established by said releasing of said liner and said raising of said work string; and (h) pulling said work string out of said well.

2. The method of claim 1, wherein said method further comprises pressure testing said liner seal by increasing the fluid pressure in said existing casing.

3. A method for installing and cementing a liner in a well, said method comprising:

(a) running a liner assembly into said well, said liner assembly comprising
  i) a tubular liner,
  ii) an anchor connected to said liner, said anchor being in an unset position in which fluid is able to flow around said liner assembly in the annulus between said liner assembly and said well,
  iii) an installation tool releasably engaging said anchor,
  iv) a return flow diverter connected to said liner below said anchor and having a port allowing fluid communication from said annulus into said flow diverter, and
  v) a tubular conduit extending through said anchor, installation tool, and said flow diverter and into said liner;

(b) actuating said installation tool to set said anchor, said anchor securing and sealing said liner in an existing casing of said well and thereby substantially preventing direct fluid flow around said liner assembly from said annulus to said existing casing;

(c) disengaging and raising said installation tool away from said anchor to provide a path for fluid flow through said anchor and around said conduit;

(d) injecting cement through said conduit into said liner and annulus after said disengaging and raising of said installation tool and allowing well fluid displaced by said cement to flow from said annulus into said existing casing via said diverter port and said path provided by said disengaging and raising said installation tool.

4. The method of claim 3, wherein said anchor comprises an expandable tubular.

5. The method of claim 3, wherein said anchor comprises an expandable sleeve.

6. The method of claim 3, wherein said liner assembly includes a seal for sealing said conduit in said liner downhole of said return flow diverter and substantially preventing direct flow of fluid around said conduit.

7. The method of claim 6, wherein said conduit seal is preset.

8. The method of claim 6, wherein said method comprises setting said conduit seal.

9. The method of claim 3, wherein said method further comprises pressure testing said liner seal by increasing the fluid pressure in said existing casing.

10. The method of claim 9, wherein said return flow diverter comprises a one-way seal mounted above said diverter port.

11. The method of claim 3, wherein said return flow diverter comprises
  i) a cylindrical body defining said diverter port,
  ii) a cover mounted on said body, said cover movable from an open position, in which said diverter port is open, to a closed position, in which said diverter port is closed, and
  iii) a transmission operable to move said cover from said open position to said closed position.

12. The method of claim 11, wherein said return flow diverter comprises a one-way seal mounted above said diverter port.

13. The method of claim 12, wherein said method further comprises pressure testing said liner seal by increasing the fluid pressure in said existing casing.

14. The method of claim 3, wherein said return flow diverter comprises a one-way seal mounted above said diverter port.

15. A method for installing a liner in a well, said method comprising:

(a) running a liner assembly into said well, said liner assembly comprising
  i) a tubular liner,
  ii) an anchor connected to said liner, said anchor being in an unset position in which fluid is able to flow around said liner assembly in the annulus between said liner assembly and said well,
  iii) an installation tool releasably engaging said anchor,
  iv) a return flow diverter connected to said liner below said anchor and having a port allowing fluid communication from said annulus into said flow diverter,
  v) a tubular conduit extending through said anchor, installation tool, and said flow diverter and into said liner; and
  vi) a one-way seal mounted between said tubular conduit and said liner or said flow diverter above said flow diverter port and allowing fluid flow upward through said one-way seal and preventing fluid flow downward past said one-way seal;

(b) actuating said installation tool to set said anchor, said anchor securing and sealing said liner in an existing casing of said well and thereby substantially preventing direct fluid flow around said liner assembly from said annulus to said existing casing; and (c) pressure testing said seal established by setting said anchor.

16. A return flow diverter adapted to allow return flow during cementing of a liner for a well, said return flow diverter comprising:

(a) a cylindrical body for installation in said well as a component of said liner, said cylindrical body having a fluid port therein adapted to allow fluids displaced by cement injected into said well to flow from an annulus between said liner and said well into said cylindrical body;

(b) a cover supported on said cylindrical body for movement after said injection of cement from an open position, in which said port is open, to a closed position, in which said port is closed by said cover;

(c) a transmission disposed within said cylindrical body and defining a cylindrical passageway, said transmission being releasably connected to said cover and operable to move said cover from said open position to said closed position: wherein said transmission is slidably supported around (d) a tubular conduit disposed in said cylindrical passageway and extending through said cylindrical body, said tubular conduit being adapted to inject cement into said liner below said body.

17. The return flow diverter of claim 16, wherein said transmission is slidably supported on said tubular conduit.

18. The return flow diverter of claim 16, wherein said cover is a cylindrical sleeve supported for axial movement across the outer surface of said cylindrical body from said open position to said closed position.

19. The return flow diverter of claim 16, wherein said cover is a cylindrical sleeve supported for axial movement across the inner surface of said cylindrical body from said open position to said closed position.

20. The return flow diverter of claim 16, wherein said cover is a cylindrical sleeve supported for rotational movement from said open position to said closed position.

21. The return flow diverter of claim 16, wherein said transmission comprises a cylindrical carriage, said carriage being adapted to receive and be supported on said tubular conduit such that said tubular conduit is capable of translational movement therein, and a cullet assembly, said cullet assembly being releasably engaged with said carriage and releasably engaging said cover.

22. The return flow diverter of claim 21, wherein said cylindrical body defines one or more slots, said cover is a cylindrical sleeve supported for axial movement across the outer surface of said cylindrical body from said open position to said closed position, and said transmission comprises a cylindrical carriage adapted to support said cullet assembly, said cullet assembly being releasably engaged with said carriage and releasably engaging said cover through said slots.

23. The return flow diverter of claim 21, wherein said flow diverter comprises a one-way seal mounted above said fluid port.

24. The return flow diverter of claim 16, wherein said flow diverter comprises a one-way seal mounted above said fluid port.

25. A liner assembly adapted to allow return flow during cementing of said liner assembly in a well, said liner assembly comprising:

(a) an anchor adapted to secure said liner assembly in said well and having an unset position in which fluid is able to flow around said liner assembly when said liner assembly is run into a well, (b) an installation tool releasably engaging said anchor and adapted to set said anchor in an existing casing of said well, and (c) the flow diverter of claim 16.

26. The liner assembly of claim 25, wherein said assembly comprises a tubular conduit adapted for injecting cement into said liner assembly.

27. The liner assembly of claim 26, wherein said transmission comprises a cylindrical carriage, said carriage being adapted to receive and be supported on said tubular conduit such that said tubular conduit is capable of translational movement therein, and a cullet assembly, said cullet assembly being releasably engaged with said carriage and releasably engaging said cover.

28. The liner assembly of claim 27, wherein said flow diverter comprises a one-way seal mounted above said fluid port.

29. The liner assembly of claim 26, wherein said flow diverter comprises a one-way seal mounted above said fluid port.

30. A liner assembly for allowing return flow during cementing of said liner assembly in a well, said liner assembly comprising:

(a) a liner;

(b) an anchor adapted to secure and seal said liner in said well;

(c) an installation tool releasably engaging said anchor and adapted to set said anchor and seal said liner; and (d) a flow diverting tool for installation in said well as a component of said liner; said flow diverting tool having i) a cylindrical body defining a port adapted to allow fluids displaced by a cement injected into said well to flow from an annulus between said liner and said well into said tool, ii) a cover mounted on said body, said cover movable after said cement injection from an open position, in which said port is open, to a closed position, in which said port is closed, and iii) a transmission operable to move said cover from said open position to said closed position; said transmission being slideably supported around iv) a tubular conduit extending through said transmission and said cylindrical body, said tubular conduit being adapted to inject cement into said liner below said body.

31. The liner assembly of claim 30, wherein said transmission is slideably supported on said tubular conduit.

32. The liner assembly of claim 31, wherein said transmission comprises a cylindrical carriage, said carriage being adapted to receive and be supported on said tubular conduit such that said tubular conduit is capable of translational movement therein, and a cullet assembly, said cullet assembly being releasably engaged with said carriage and releasably engaging said cover.

33. The liner assembly of claim 32, wherein said flow diverting tool comprises a one-way seal mounted above said port.

34. The liner assembly of claim 31, wherein said flow diverting tool comprises a one-way seal mounted above said port.

* * * * *

UNITED STATES PATENT AND TRADEMARK OFFICE

CERTIFICATE OF CORRECTION

PATENT NO. : 9,303,477 B2
APPLICATION NO. : 13/506227
DATED : April 5, 2016
INVENTOR(S) : Michael J. Harris and Martin Alfred Stulberg It is certified that error appears in the above-identified patent and that said Letters Patent is hereby corrected as shown below:

In the specification,

At column 1, line 4, delete the entire paragraph commencing with "This nonprovisional application ...".

In the claims,

In claim 16, at column 40, line 49, delete "position:" and insert therein -- position; --.

In claim 21, at column 41, line 5, delete "cullet assembly, said cullet" and insert therein -- collet assembly, said collet --.

In claim 22, at column 41, line 13, delete "cullet" and insert therein -- collet --.

In claim 22, at column 41, line 14, delete "cullet" and insert therein -- collet --.

In claim 27, at column 41, line 40, delete "cullet assembly, said cullet" and insert therein -- collet assembly, said collet --.

In claim 32, at column 42, line 36, delete "cullet assembly, said cullet" and insert therein -- collet assembly, said collet --.

Signed and Sealed this
Twelfth Day of July, 2016

Michelle K. Lee

Michelle K. Lee
*Director of the United States Patent and Trademark Office*